US011628972B2

(12) United States Patent
Simms, II

(10) Patent No.: US 11,628,972 B2
(45) **Date of Patent: *Apr. 18, 2023**

(54) CONTAINERS FEATURING IMPROVED FOOD INTEGRITY AND TAKEOUT EXPERIENCE

(71) Applicant: Waddington North America, Inc., Chelmsford, MA (US)

(72) Inventor: Russell L. Simms, II, Cleveland, TN (US)

(73) Assignee: Waddington North America, Inc., Chelmsford, MA (US)

( * ) Notice: Subject to any disclaimer, the term of this patent is extended or adjusted under 35 U.S.C. 154(b) by 294 days.

This patent is subject to a terminal disclaimer.

(21) Appl. No.: 17/197,122

(22) Filed: Mar. 10, 2021

(65) Prior Publication Data

US 2021/0198005 A1 Jul. 1, 2021

Related U.S. Application Data

(63) Continuation of application No. 16/415,211, filed on May 17, 2019, now Pat. No. 10,974,868.

(60) Provisional application No. 62/673,561, filed on May 18, 2018.

(51) Int. Cl.
*B65D 21/02* (2006.01)
*B65D 51/16* (2006.01)

(52) U.S. Cl.
CPC ..... *B65D 21/0223* (2013.01); *B65D 51/1605* (2013.01); *B65D 2205/02* (2013.01)

(58) Field of Classification Search
CPC ..... B65D 21/0223; B65D 51/1605; B65D 2205/02
See application file for complete search history.

(56) References Cited

U.S. PATENT DOCUMENTS 3,117,692 A * 1/1964 Carpenter ..... B65D 43/0212 206/508
3,595,425 A 7/1971 Eicholtz
4,844,263 A 7/1989 Hadtke
6,257,401 B1 7/2001 Mangla
(Continued)

OTHER PUBLICATIONS

Office Action for U.S. Appl. No. 16/415,211, dated Aug. 7, 2020, 13 Pages.

(Continued)

*Primary Examiner* — James N Smalley
(74) *Attorney, Agent, or Firm* — Maine Cernota & Rardin

(57) ABSTRACT

A container lid and base assembly includes lid and base stacking features, as well as base chamfers that align with vents provided in the lid. When a plurality of the container assemblies is stacked, the lid and base stacking features nest with each other, while the chamfers align with corresponding vents in the stacked assemblies so that none of the vents is blocked by a next-higher container assembly. The stacking features can be centrally located, and the vents can be peripherally located. A plurality of the container assemblies can have differing sizes and/or shapes, while including mutually compatible stacking features, thereby enabling container assemblies of differing sizes to be stacked without blocking any of the vents thereof. The vents can be holes or "C" vents. The lid and/or base can be manufacturable by thermoforming. The lid and base can be separate, or joined by a hinge.

14 Claims, 25 Drawing Sheets

(56) References Cited

U.S. PATENT DOCUMENTS

| | | | | |
|---|---|---|---|---|
| 6,786,351 | B2 * | 9/2004 | Krueger | B65D 81/261 206/508 |
| 10,308,394 | B1 * | 6/2019 | Robl | B65D 21/0223 |
| 2003/0062365 | A1 | 4/2003 | Krueger | |
| 2006/0000840 | A1 | 1/2006 | Kipperman | |
| 2012/0312820 | A1 | 12/2012 | Cadiente | |
| 2015/0021321 | A1 | 1/2015 | Gosen | |

OTHER PUBLICATIONS

Notice of Allowance for U.S. Appl. No. 16/415,211, dated Jan. 29, 2021, 5 Pages.

* cited by examiner

CONTAINERS FEATURING IMPROVED FOOD INTEGRITY AND TAKEOUT EXPERIENCE

RELATED APPLICATIONS

This application is a continuation of U.S. application Ser. No. 16/415,211, filed on May 17, 2019. Application Ser. No. 16/415,211 claims the benefit of U.S. Provisional Application No. 62/673,561, filed May 18, 2018, which is herein incorporated by reference in its entirety for all purposes.

FIELD OF THE INVENTION

This invention relates to food containers featuring improved food integrity and takeout experience, and more particularly to food containers having venting and stacking features wherein a plurality of containers can be stacked on one another without interfering with the venting system.

BACKGROUND OF THE INVENTION

Plastic containers for holding food and consumer goods are in common use. Oftentimes, such containers are used to serve prepared foods by restaurants and other food service establishments, and food is either consumed by the user at the restaurant or the takeout container is carried out by the user for subsequent consumption at home, work or another location. Accordingly, most restaurants, cafeterias, and food service providers maintain a stock of empty containers for serving freshly prepared foods to consumers for eat-in and/or takeout purposes. Often these prepared foods are either cooked to order or are heated to improve the taste or enjoyment of the food. Typically, containers used for this purpose are referred to as take-out, takeaway, or to-go containers. These "to-go" type containers often are made of a plastic material, having a lid and base, either as separate pieces or connected by a hinge.

A common desire of both consumers and food service professionals is maintaining the integrity and texture, such as crispness, of the prepared food within the container. However, it has been challenging to maintain the food temperature in a closed container and still prevent condensation and moisture from becoming trapped within the closed container and causing the contained food to become soggy or otherwise unappetizing. One approach is to provide vent holes in the lid of the container. However, such vent holds can become blocked by adjacent containers when the containers are vertically stacked.

Therefore, there is a need for a container that can hold heated foods and has an adequate venting system that maintains food integrity and avoids sogginess. These and other needs as shall hereinafter appear are addressed by the present invention.

SUMMARY OF THE INVENTION

The present invention is directed to container assemblies, including lid and base combinations, providing at least one vent in the lid and preferably a plurality of vents. The vents are located in the upper panel of the lid to take advantage of the natural rise of heat and steam from heated foods that are placed inside the container. The plurality of vents are preferably positioned at a plurality of locations on the lid upper panel to allow for multiple paths and distributed egress of moisture and steam from the container without condensing onto the food items.

While it has been known in the prior art to provide vent holes in a container assembly for preventing moisture build-up within the container, configuring an optimal venting system is not straightforward. Since takeout containers are often transported in a stacked configuration, vents provided on top of the lid often get covered with the container stacked above it, thus inhibiting proper venting or venting effectiveness. One approach to counteracting the covered vents is to provide vents in the sidewall, however, sidewall vents are not ideal as moisture can still condense on the interior surface of the lid. Sidewall vents can also be covered when a consumer places a takeout container in a carrying bag during transportation. Therefore vents on the sidewalls of a lid are not deemed adequate to provide the proper level of venting. Vents situated on the upper lid portion of a container are not very effective when containers are used or carried in a stacked configuration. The present invention provides vented containers wherein the vents remain unblocked and functional even when the containers are arranged or transported in a stacked configuration.

The present invention can be used in connection with a variety of plastic containers for food and consumer products. The plastic used could be a thermoplastic material such as polyethylene terephthalate (PETE), polystyrene, polylactic acid (PLA), polypropylene, polyethylene, or other similar plastic material. The container may be, for example, from 0.010 to 0.090 inches thick. Such containers are typically made by thermoforming or injection molding. The container could be made in a variety of sizes and configurations depending on the purpose of the containers. The container could be used for food, such as baked goods, fruit, vegetables, meat, cheese, salads, eggs and other food items. The container could also be used for retail products such as batteries, compact disks, razors, electronics, hardware, tools and other products.

The invention provides container assemblies that are stackable upon each other, with either the lid or the base having a projection that corresponds with a recess in the opposing lid or base. Like containers in a sealed configuration may be stacked upon each other, allowing the corresponding stacking features to provide a partial interference and for maintaining each container in the stack to avoid incidental sliding of a container. Containers of differing shapes and sizes may be configured to have corresponding stacking features, thereby allowing stacking of a family of similar and dissimilar containers, while maintaining an interference stacking feature.

The invention provides a stack of container assemblies having corresponding stacking features and a plurality of vents situated on upper surfaces of each lid, with each base of the container assembly having a plurality of chamfered regions that correspond to the locations of the lid vents, thereby allowing the lid vents of each container assembly to remain open and unimpeded, while another container is stacked on top of it.

A first general aspect of the present invention is a container assembly suitable for containing food items. The container assembly includes a lid comprising a lid top wall, a lid sidewall, and a lid peripheral rim, said lid top wall comprising at least one vent and a first container lid stacking feature, a base having a base bottom wall, a base sidewall, and a base peripheral rim, said base bottom wall comprising at least one chamfer and a first container base stacking feature, each of said at least one chamfer of the base being positioned below a corresponding vent of the at least one vent of the lid, said lid and base being mutually engageable to form a first container assembly, said first container assembly being adapted for supporting a substantially identical second container assembly above the first container assembly in a stacked configuration, wherein said second container assembly includes second container lid and base stacking features, at least one vent, and at least one chamfer. When the first and second container assemblies are in the stacked configuration, said first container lid stacking feature engages with said second container base stacking feature, and each of the chamfer features of the base of the second container assembly aligns with a corresponding vent of the lid of the first container assembly, such that said all of the vents included in the lid of the first container assembly remain unblocked by said second container assembly.

In embodiments, the first container lid stacking feature is a protrusion that extends upward from the top wall of the lid of the first container assembly, and the first container base stacking feature is an indentation that extends inward from the bottom wall of the base of the first stacking assembly, said indentation being shaped to enable said protrusion to nest at least partially therein.

In any of the above embodiments, the first container lid stacking feature can be a recess that extends downward and inward from the top wall of the lid of the first container assembly, and the first container base stacking feature is a protrusion that extends downward from the bottom wall of the base of the first container assembly, said indentation being shaped to enable said protrusion to nest at least partially therein.

In any of the above embodiments, the lid stacking feature of the first container assembly can be centrally located on the lid top wall of the first container assembly, and the base stacking feature of the first container assembly can be centrally located on the base bottom wall of the first container assembly.

In any of the above embodiments, at least one of the vents of the first container assembly can be a hole provided in the lid of the first container assembly.

In any of the above embodiments, at least one of the vents of the first container assembly can be a "C" vent formed into the top wall of the lid of the first container assembly.

In any of the above embodiments, the lid and base of the first container assembly can be separate elements of the first container assembly.

In any of the above embodiments, the lid and base of the first container assembly can be joined to each other by a hinge. In some of these embodiments, the hinge is a living hinge.

In any of the above embodiments, at least one of the lid and base of the first container assembly cam be made of plastic, and is structurally compatible with manufacture thereof by thermoforming.

In any of the above embodiments, the top wall of the lid of the first container assembly can include at least four vents.

In any of the above embodiments, the vents of the lid of the first container assembly can be formed planar with the top wall of the lid of the first container assembly.

In any of the above embodiments, each of the bases of the first and second container assemblies can include a plurality of compartments that are separated by channels formed in the base, such that when the first and second container assemblies are in the stacked configuration, the channels formed in the base of the second container assembly provide passages through which heated air escaping from the vents in the lid of the first container assembly can escape to the surrounding environment.

A second general aspect of the present invention is a plurality of container assemblies, each of the container assemblies having a structure as described above, the lid and base stacking features of all of the container assemblies in the plurality of container assemblies being mutually compatible with each other. The container assemblies are stackable in a stacked configuration, wherein all pairs of lid and base stacking features that are in proximal contact each other are nestingly engaged with each other, thereby providing stability to the stacked configuration, and none of the vents of the container assemblies is blocked by a next-higher container assembly in the stack.

In embodiments, all of the container assemblies are substantially identical in size and shape, and wherein each of the vents that is proximal to a bottom wall of a next higher container assembly is aligned with a chamfer of the bottom of the next higher container assembly, so that the vent is not blocked by the bottom of the next higher container assembly.

And in any of the above embodiments, the plurality of container assemblies can include container assemblies that differ from each other in at least one of size and shape.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
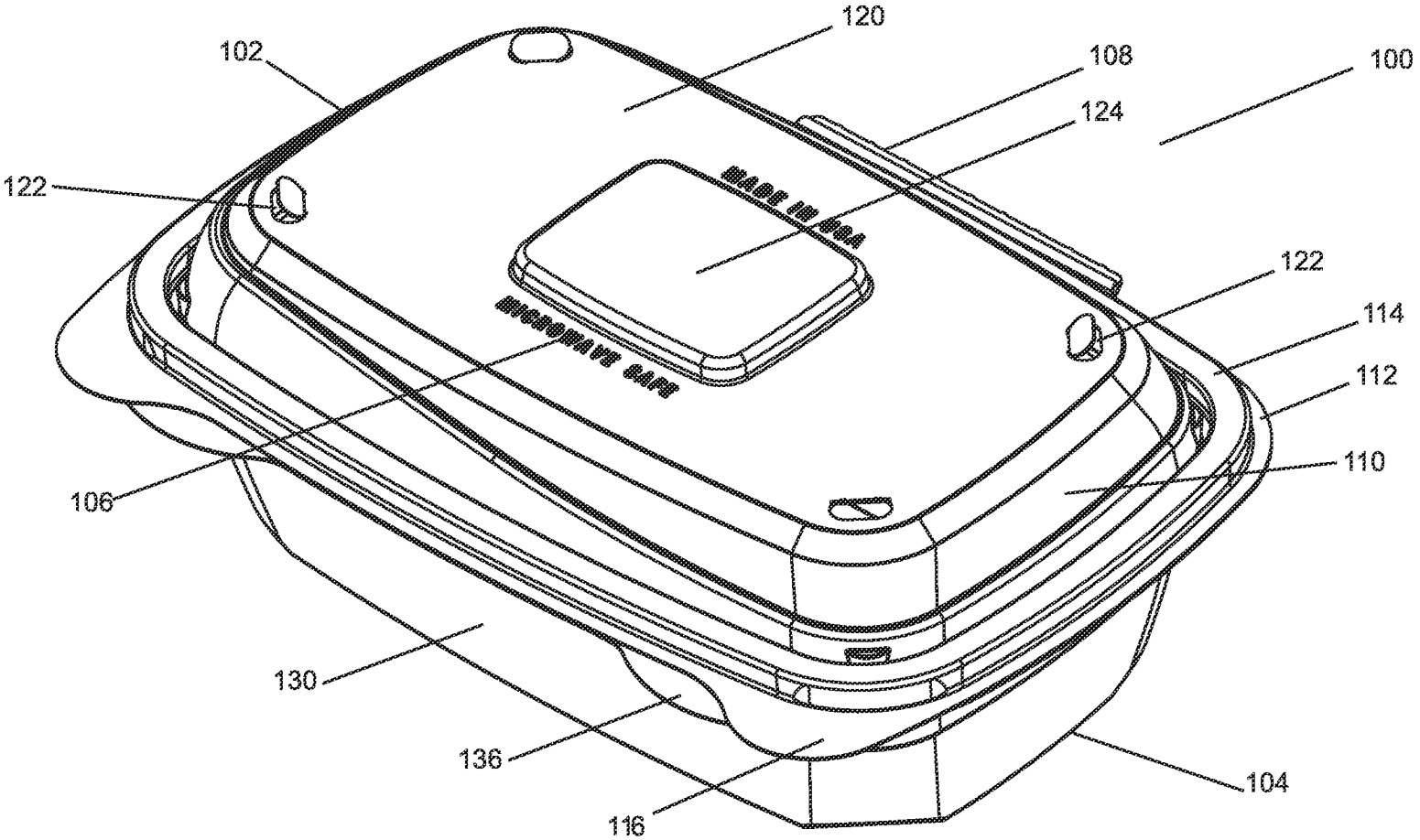
FIG. 1A is a top isometric view drawn to scale of an oblong container assembly having a lid that is joined to the base by a hinge.

FIGS. 1A-1H show a container assembly 100, comprising lid 102, and base 104 connected to each other by hinge 108. Lid 102 has a generally planar lid upper panel 120, lid upper panel 120 extending peripherally outwardly to a plurality of lid sidewalls 110, said lid sidewalls extending downward and peripherally outwardly to lid sealing channel 114. Lid sealing channel 114 terminates into a lid peripheral flange or lip 112 with a lid tab 116 extending from a portion of lid peripheral flange or lip 112. Indicia 106 may be embossed or printed on the lid 102 or base 104 to provide a user with directions for use or to give other information such as a provider or manufacturer.

Lid stacking projection 124 is a protrusion rising above the planar level and is located near the middle of lid upper panel 120. Stacking projection 124 is of an adequate size and shape for mutual cooperation with base stacking recess 144 (shown in FIG. 1B). A plurality of lid vents 122 are located on lid upper panel 120 proximate the peripheral corners of the lid upper panel 120. In a preferred embodiment, lid vents 122 are "C" vents stamped into the planar surface of lid upper panel 120. It is envisaged that the vents may be of any shape, size, or quantity and may be incorporated into the upper lid panel at any desired location.

Figure 1B:
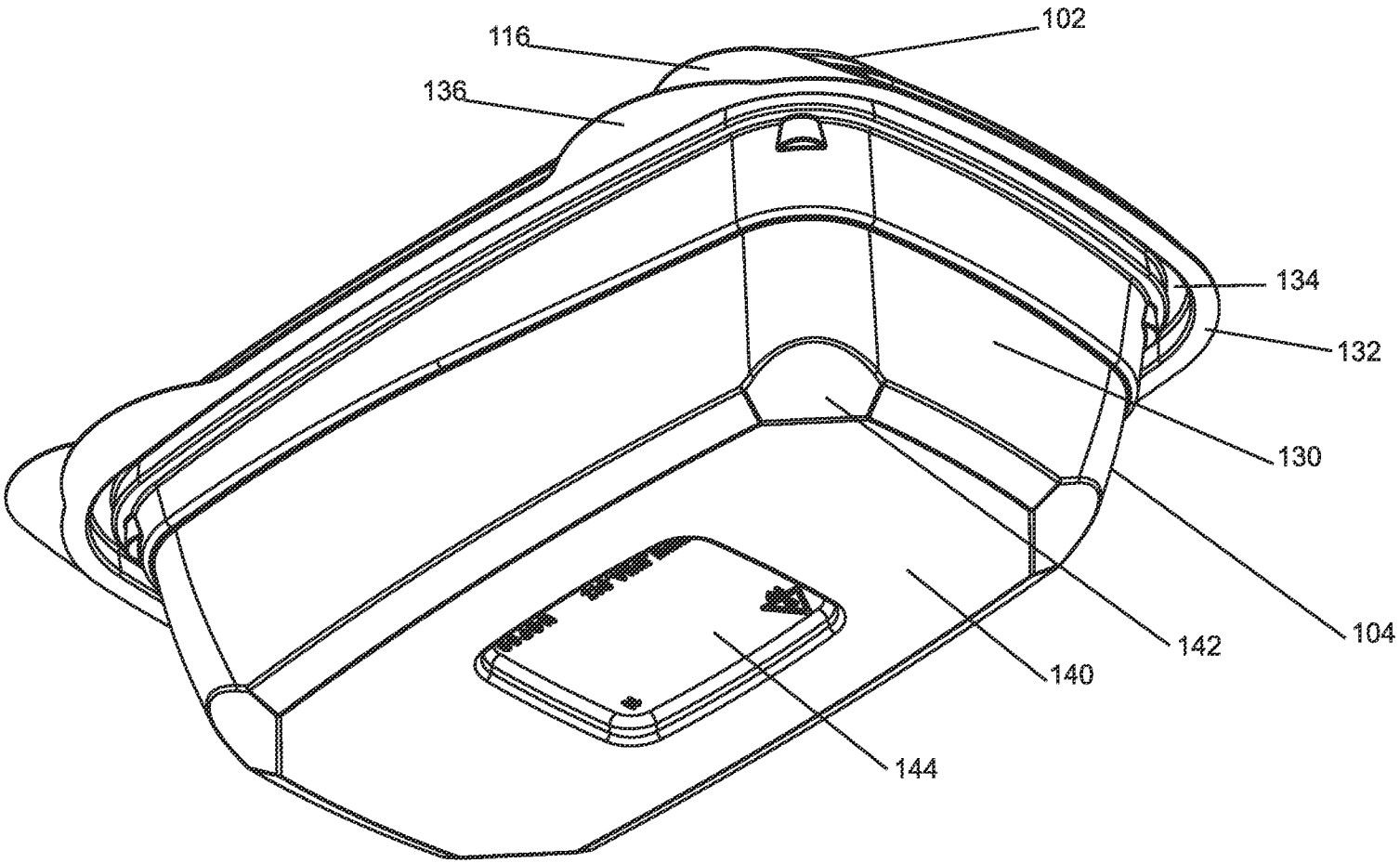
FIG. 1B is a bottom isometric view drawn to scale of the container assembly of FIG. 1A.

FIG. 1B shows a perspective bottom view of container assembly 100, showing base 104, having a generally planar base bottom panel 140 extending to base sidewall 130, said base sidewall 130 extending upward from the base bottom panel to form a cavity area or receptacle configured to receive and hold foods and/or other goods. Base sealing channel 134 extends peripherally around base sidewall 130 and engages with lid sealing channel 114 (shown in FIG. 1A), when lid 102 and base 104 are in a closed configuration. Base peripheral flange 132 extends peripherally around base sealing channel, with base tab 136 extending outwardly from a portion of the base peripheral flange 132.

Base stacking recess 144 is a depression located near the middle of base bottom panel 140 and is of a size and shape that mutually cooperates with lid stacking projection 124 (shown in FIG. 1A). A plurality of base vent chamfers 142 are located on base bottom panel 140, the base vent chamfers extending partially up the base sidewall 130. Base vent chamfers 142 are configured to allow lid vents 122 to remain unblocked when the container assemblies are in a stacked configuration. It is envisaged that the chamfers may be of any shape, size, or quantity to correspond with lid vents and may be incorporated into the base bottom panel at any desired location.

Figure 1C:
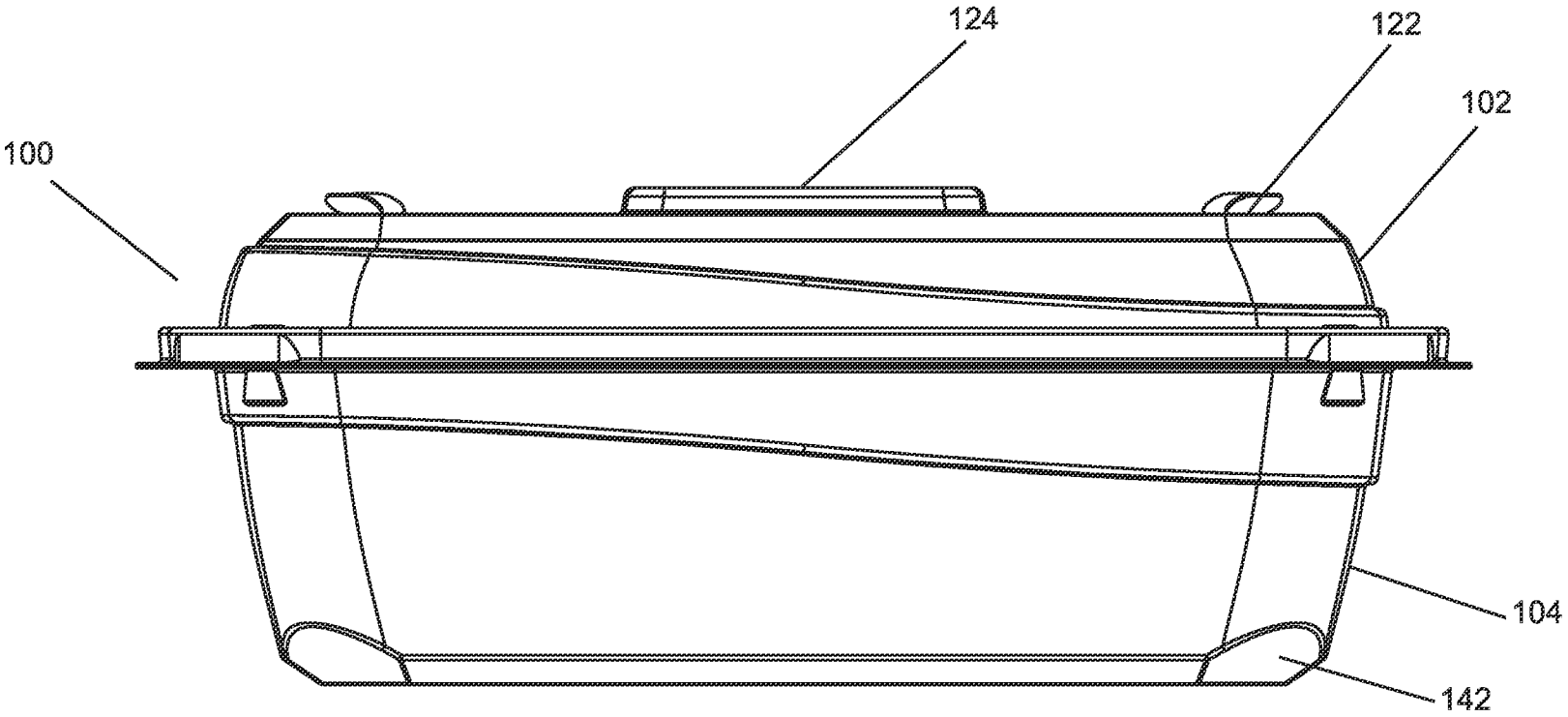
FIG. 1C is a front view drawn to scale of the container assembly of FIG. 1A.
Figure 1D:
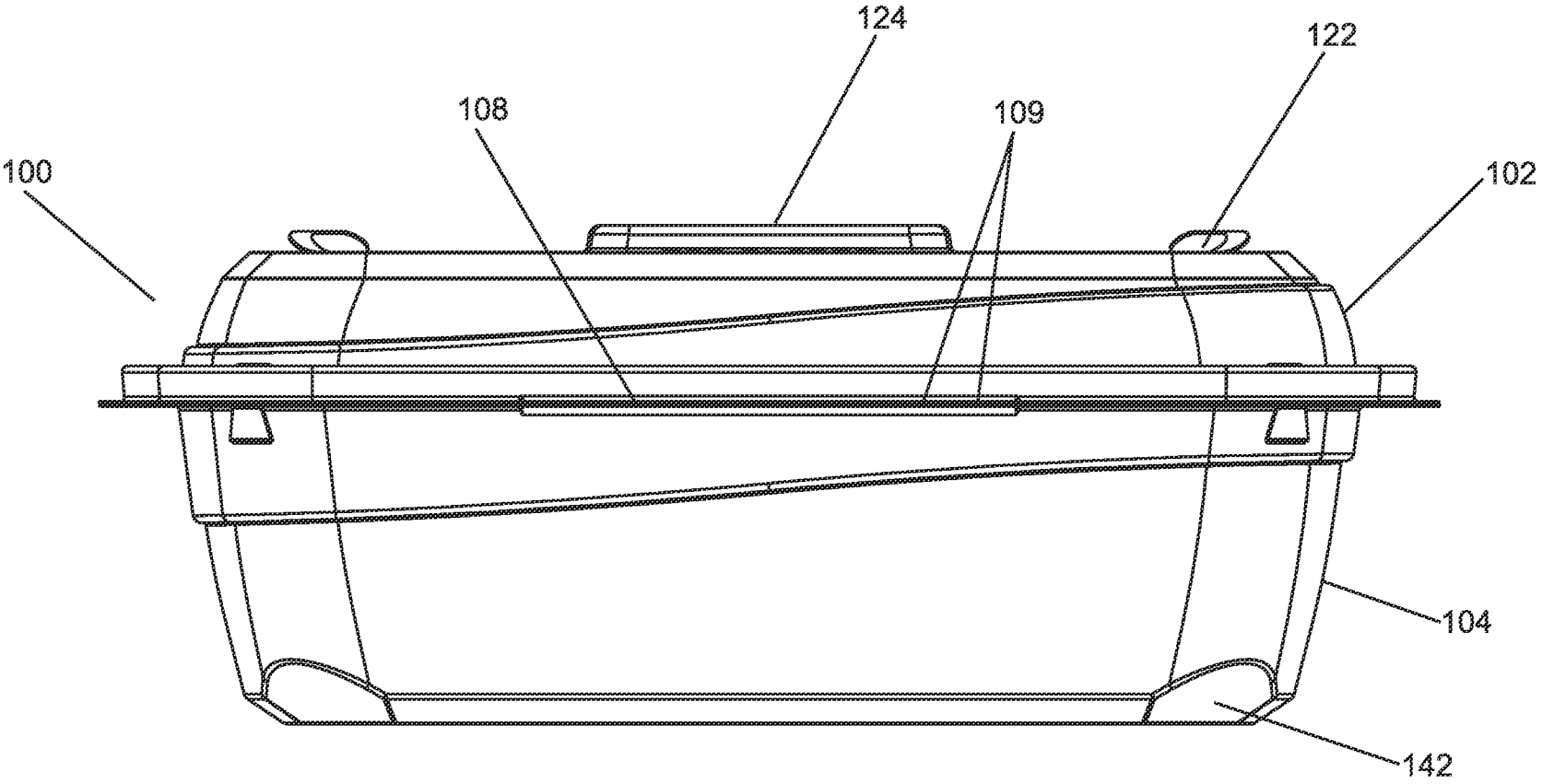
FIG. 1D is a back view drawn to scale of the container assembly of FIG. 1A.
Figure 1E:
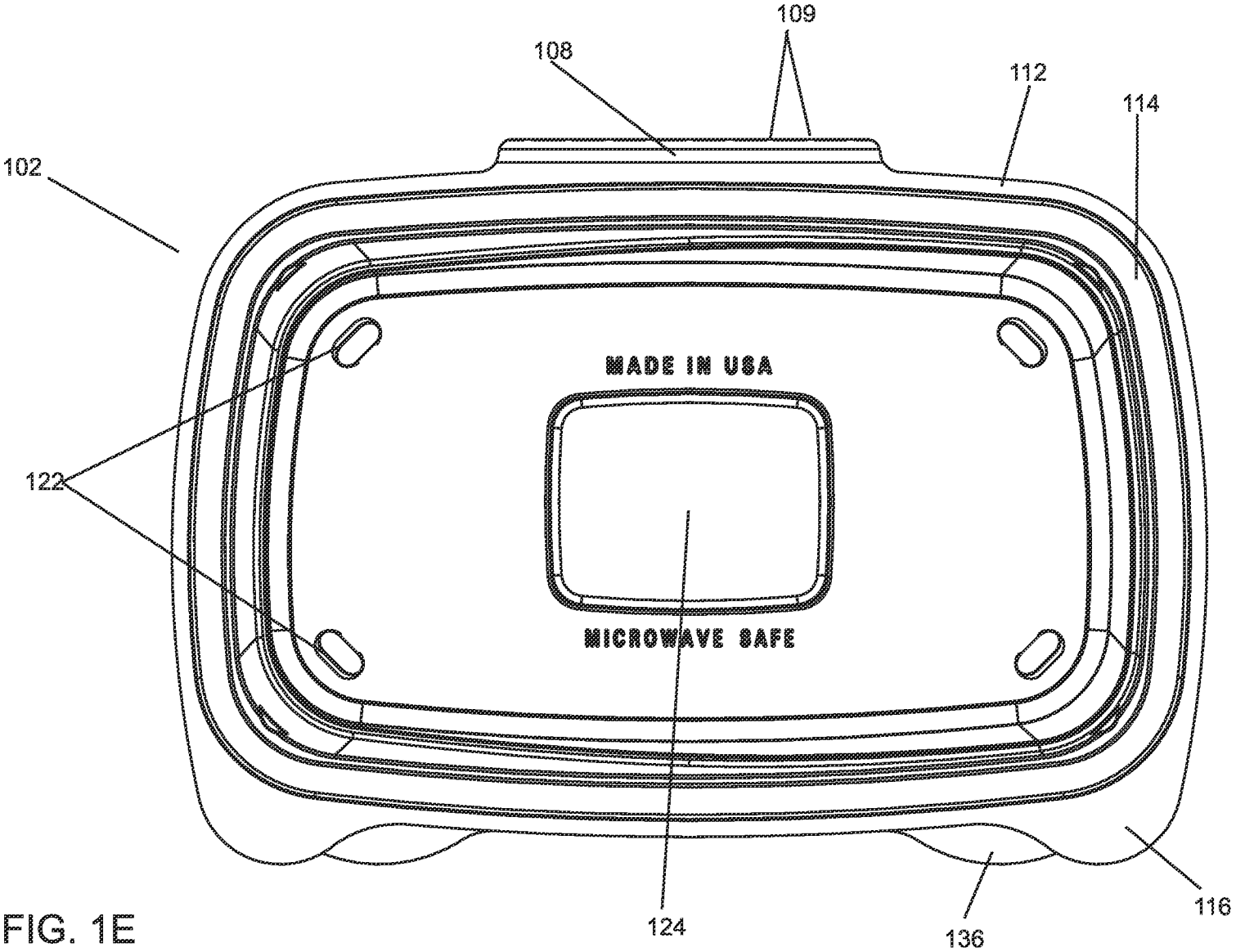
FIG. 1E is a top view drawn to scale of the container assembly of FIG. 1A.
Figure 1F:
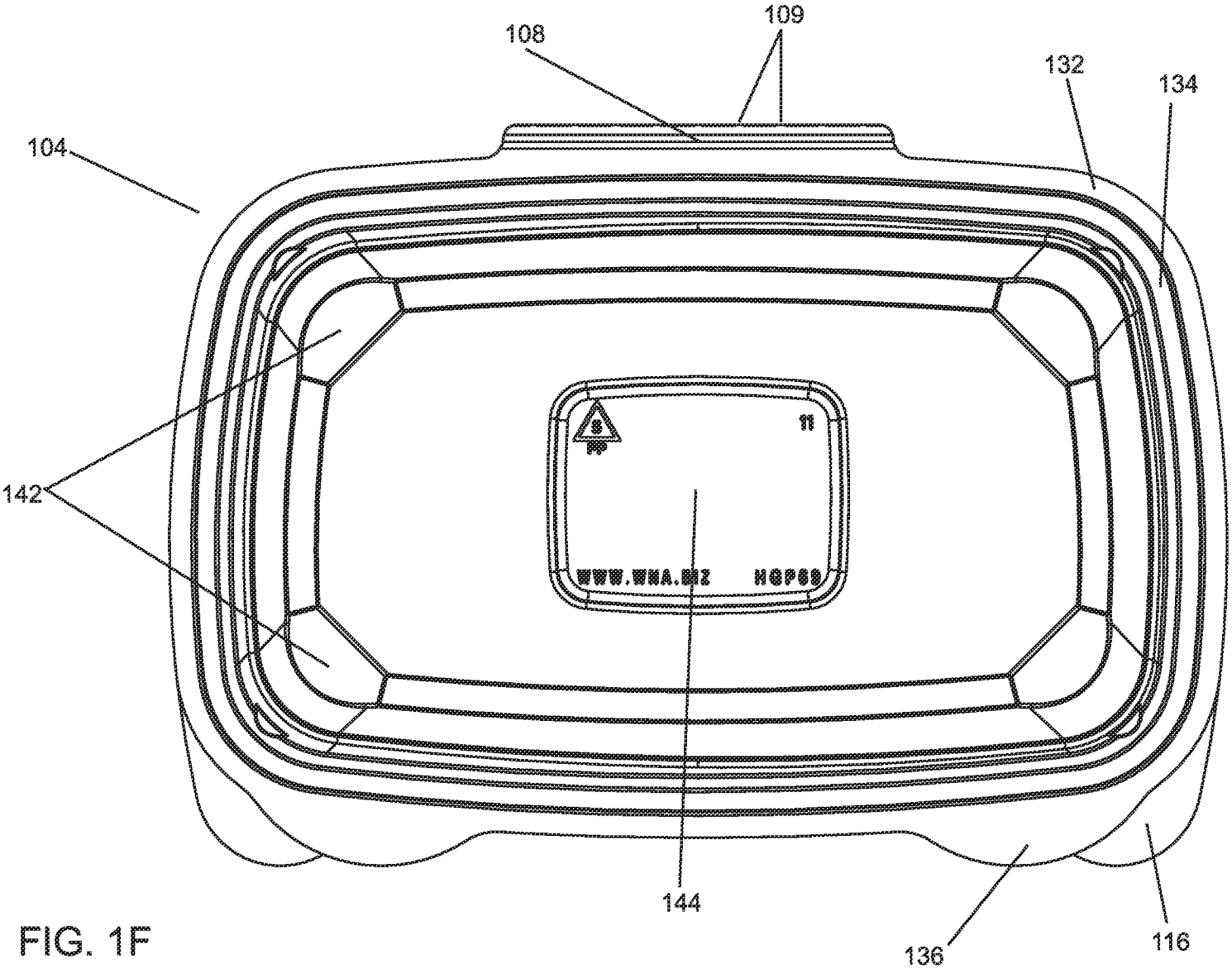
FIG. 1F is a bottom view drawn to scale of the container assembly of FIG. 1A.
Figure 1G:
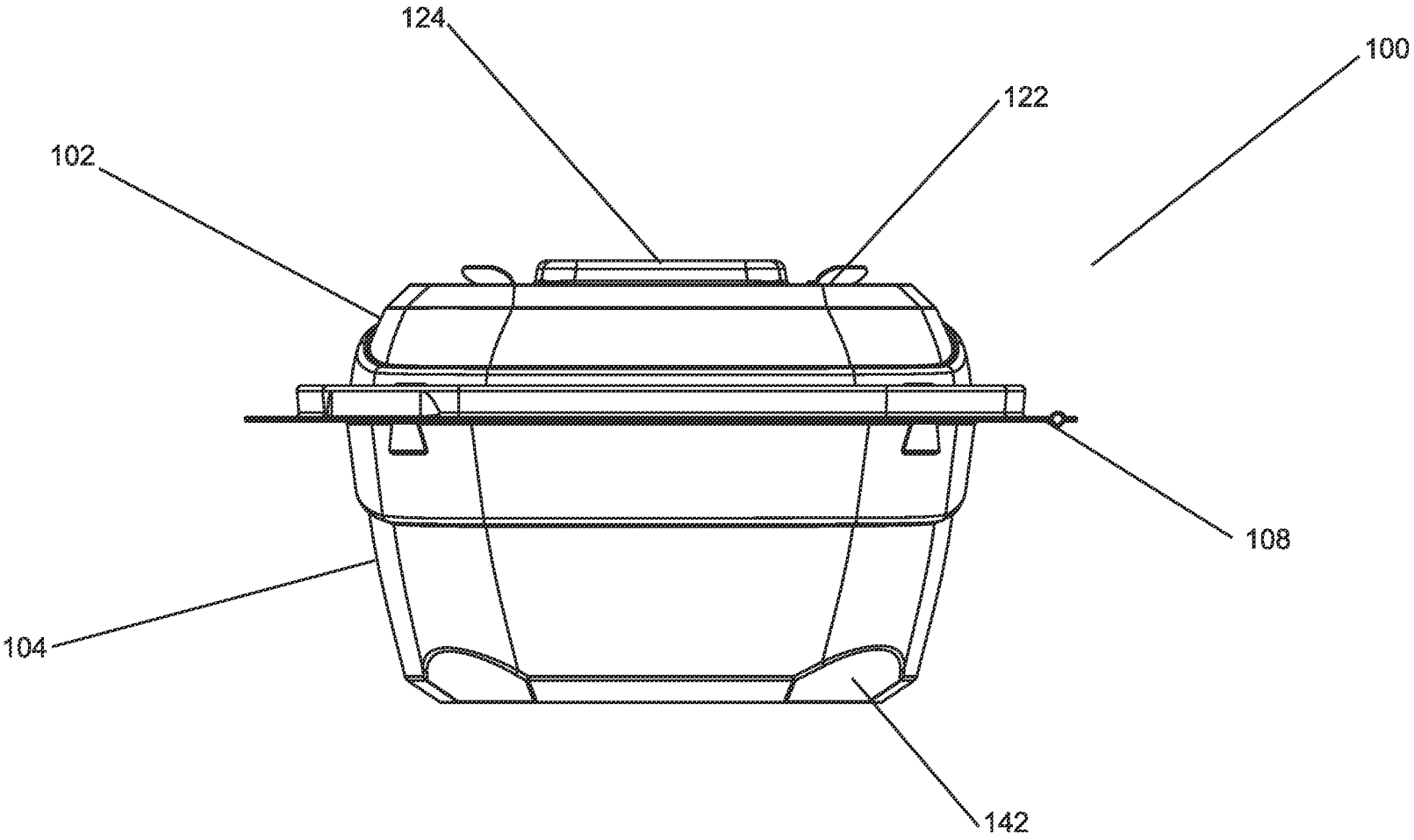
FIG. 1G is a right side view drawn to scale of the container assembly of FIG. 1A.
Figure 1H:
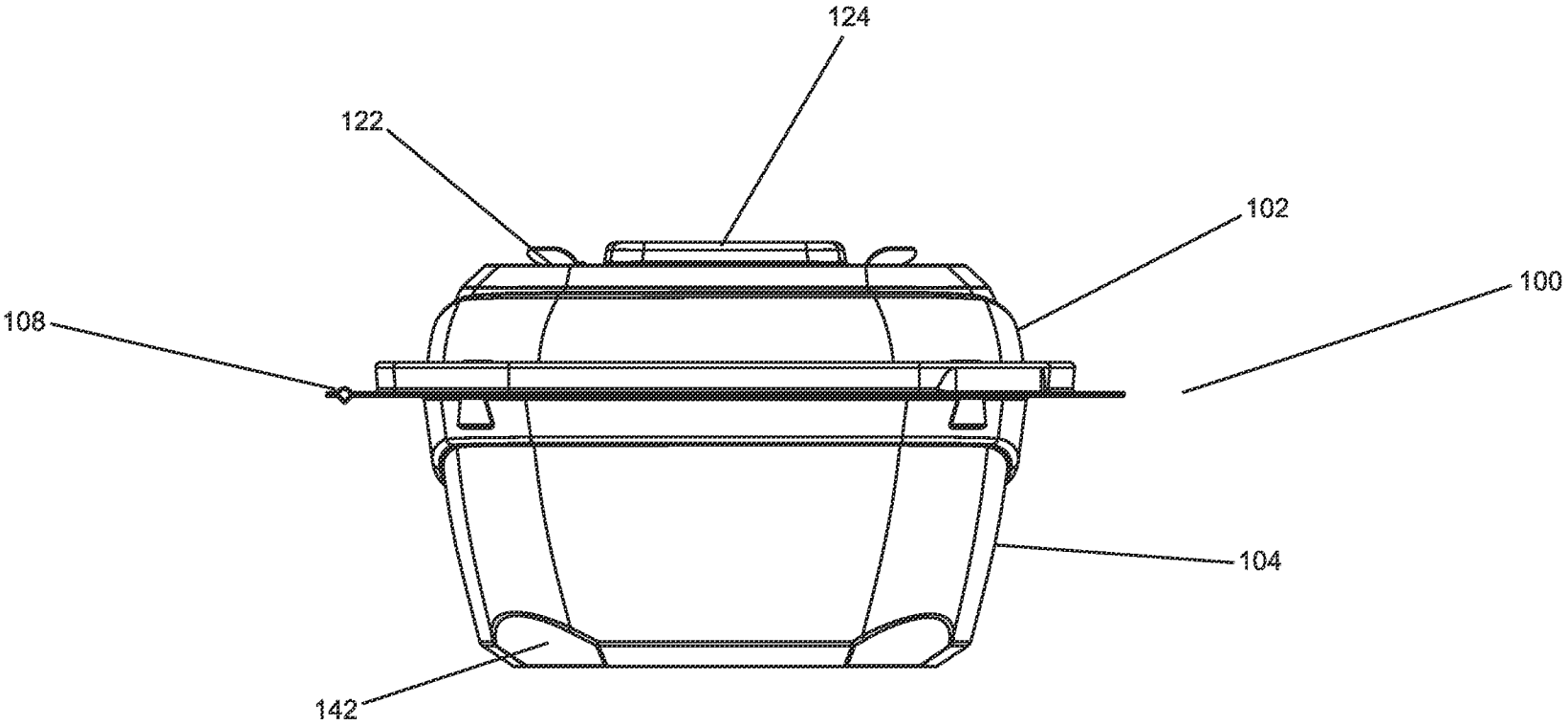
FIG. 1H is a left side view drawn to scale of the container assembly of FIG. 1A.

FIG. 1C is a side view of container assembly 100 shown from the side that is opposite to the hinge 108. FIG. 1D is a side view of container assembly 100 shown from the side that is the side that includes the hinge 108. It can be seen in FIG. 1D that the hinge 108 extends from lid 102 and base 104 to attach the lid and base as a unitary part. Hinge 108 may be of any known configuration or design known in the art. The peripheral edge of hinge 108 has perforations 109, to allow a user to easily separate lid 102 from base 104 as desired. Perforations may be of any configuration known in the art including micro-perforations, frangible lines, or combinations thereof. FIG. 1E is a top view of container assembly 100, FIG. 1F is a bottom view of the assembly 100, FIG. 1G is a right side view of the container assembly 100, and FIG. 1H is a left side view of the container assembly 100.

Figure 2A:
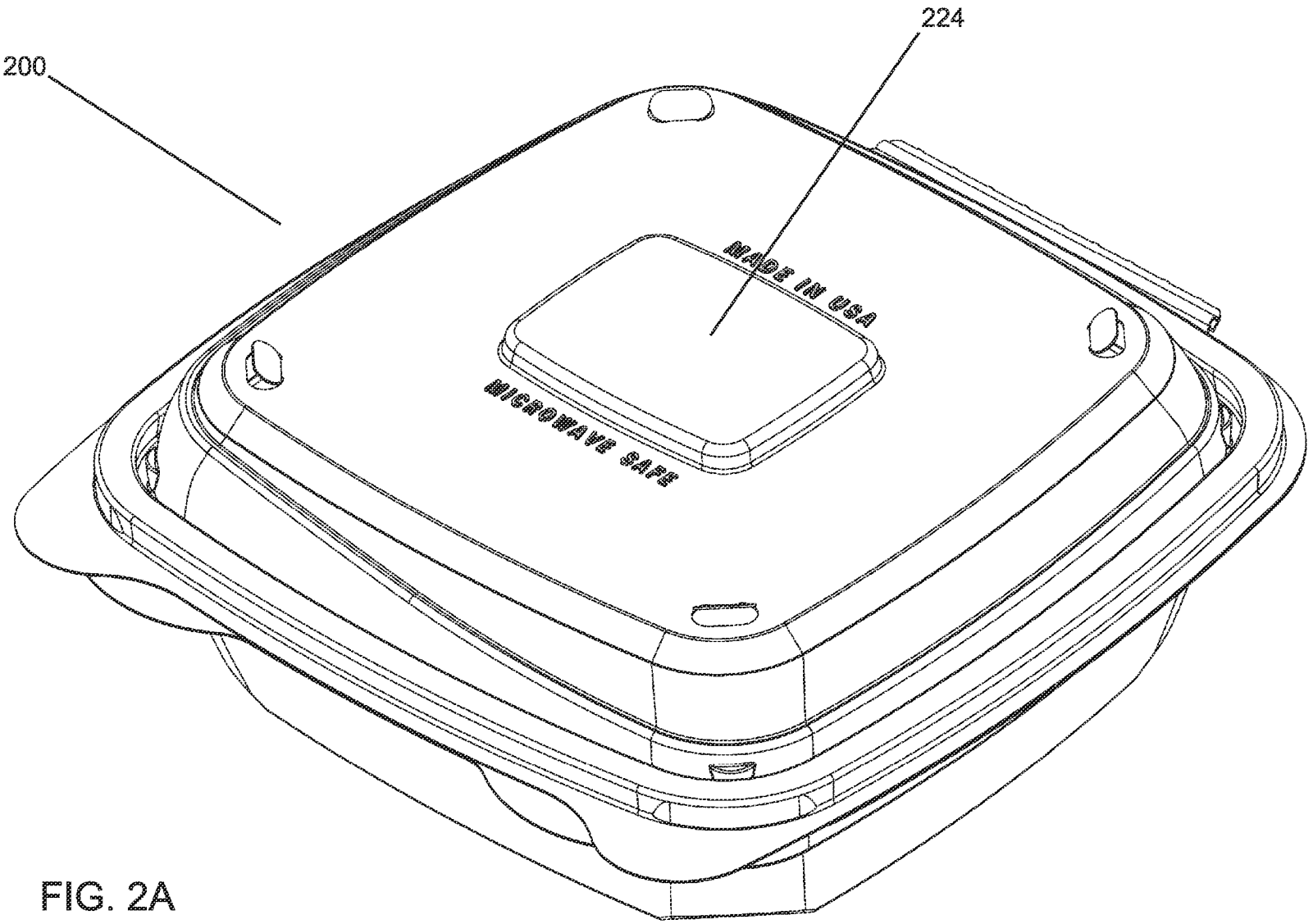
FIG. 2A is a top isometric view drawn to scale of a square container assembly.
Figure 2B:
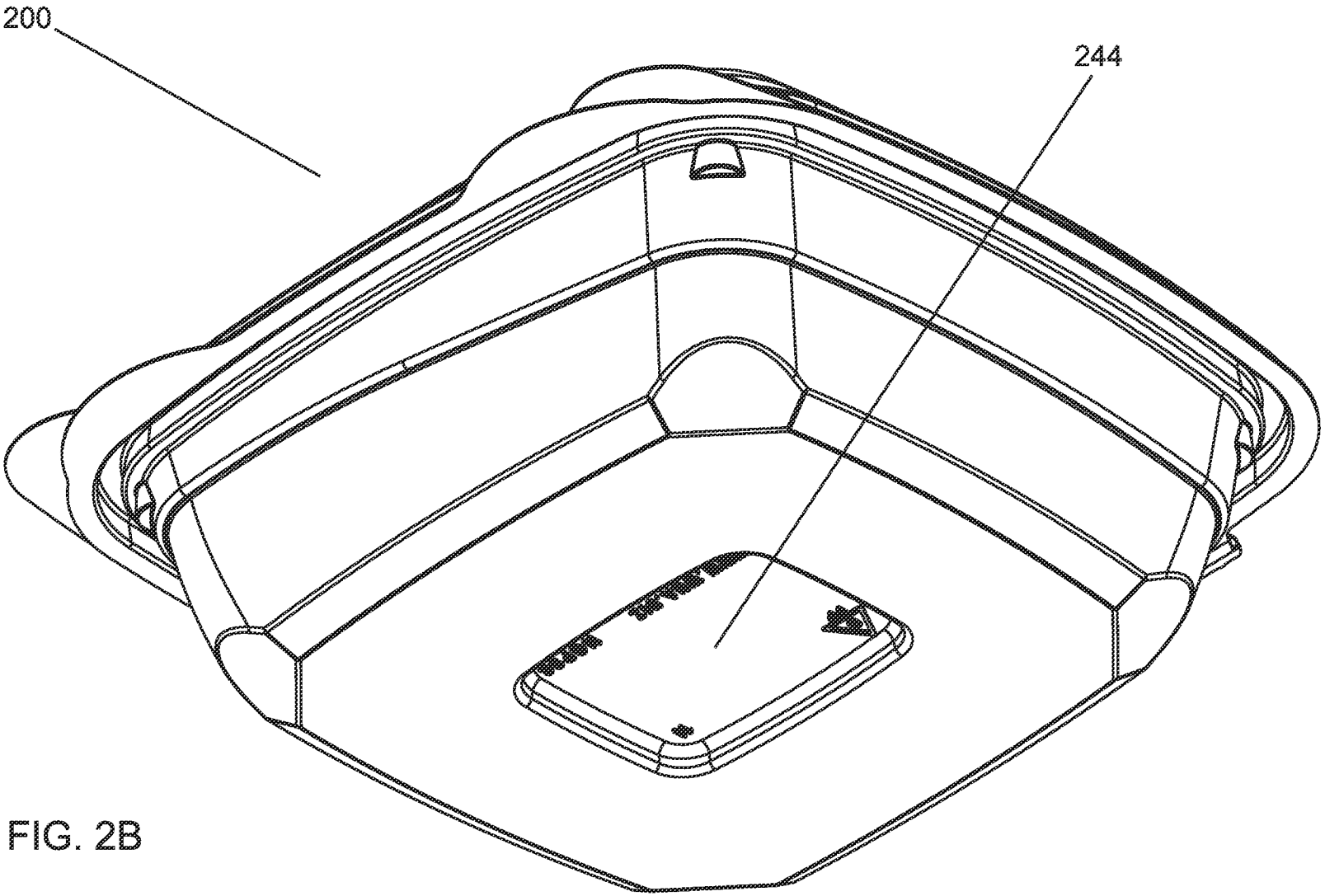
FIG. 2B is a bottom isometric view drawn to scale of the container assembly of FIG. 2A.

In a variant embodiment shown in FIGS. 2A-2B, container assembly 200 is square and has a larger footprint than container assembly 100 shown in FIGS. 1A-1H. Container assembly 200, however, maintains the same size and configuration of lid stacking projection 224 and base stacking recess 244 as the lid stacking projection 124 and base stacking recess 144 of container assembly 100 respectively (as shown in FIGS. 1A-1H).

Figure 2C:
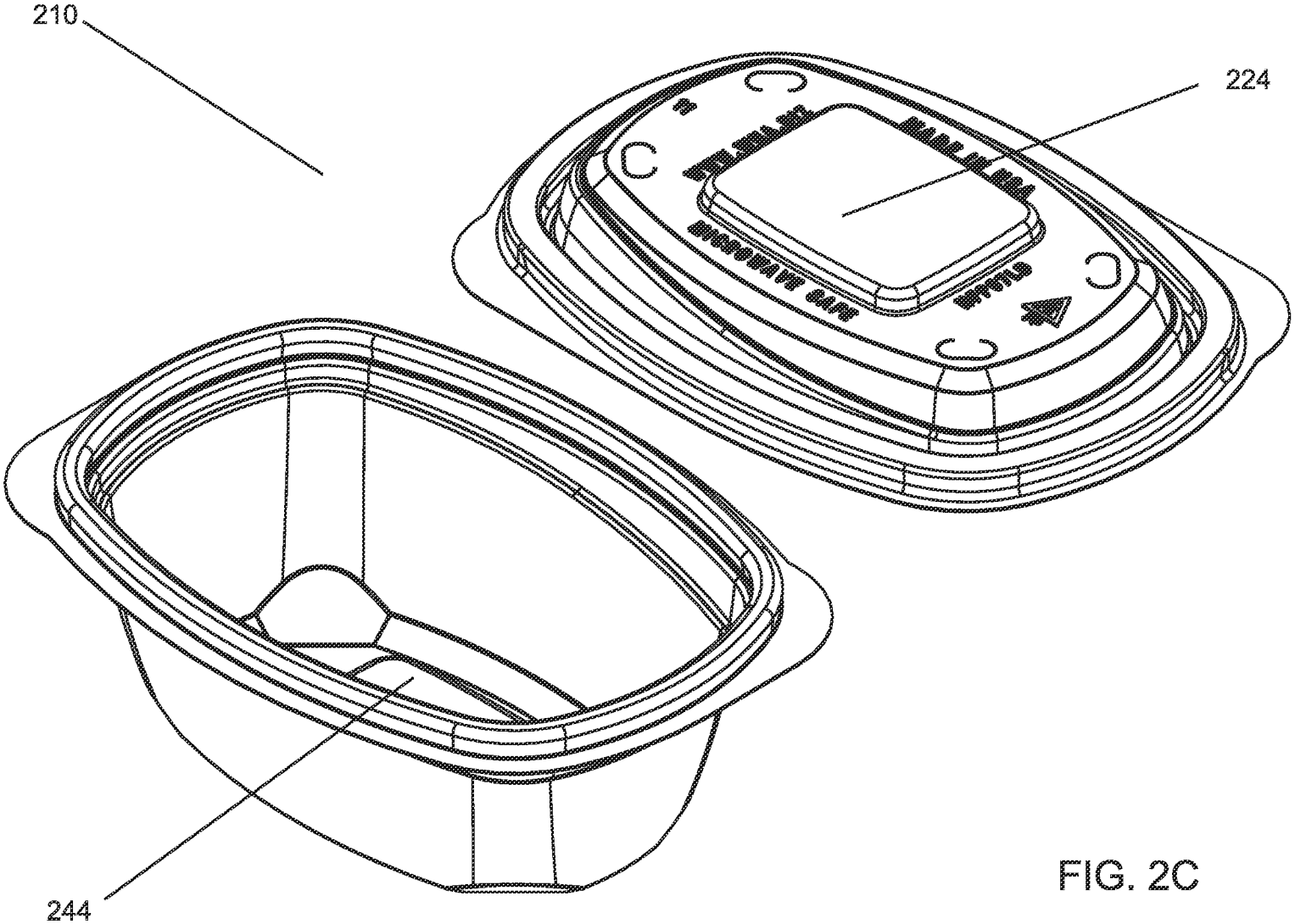
FIG. 2C is a top isometric view drawn to scale of an oval container assembly having a lid that is separate from the base.
Figure 2D:
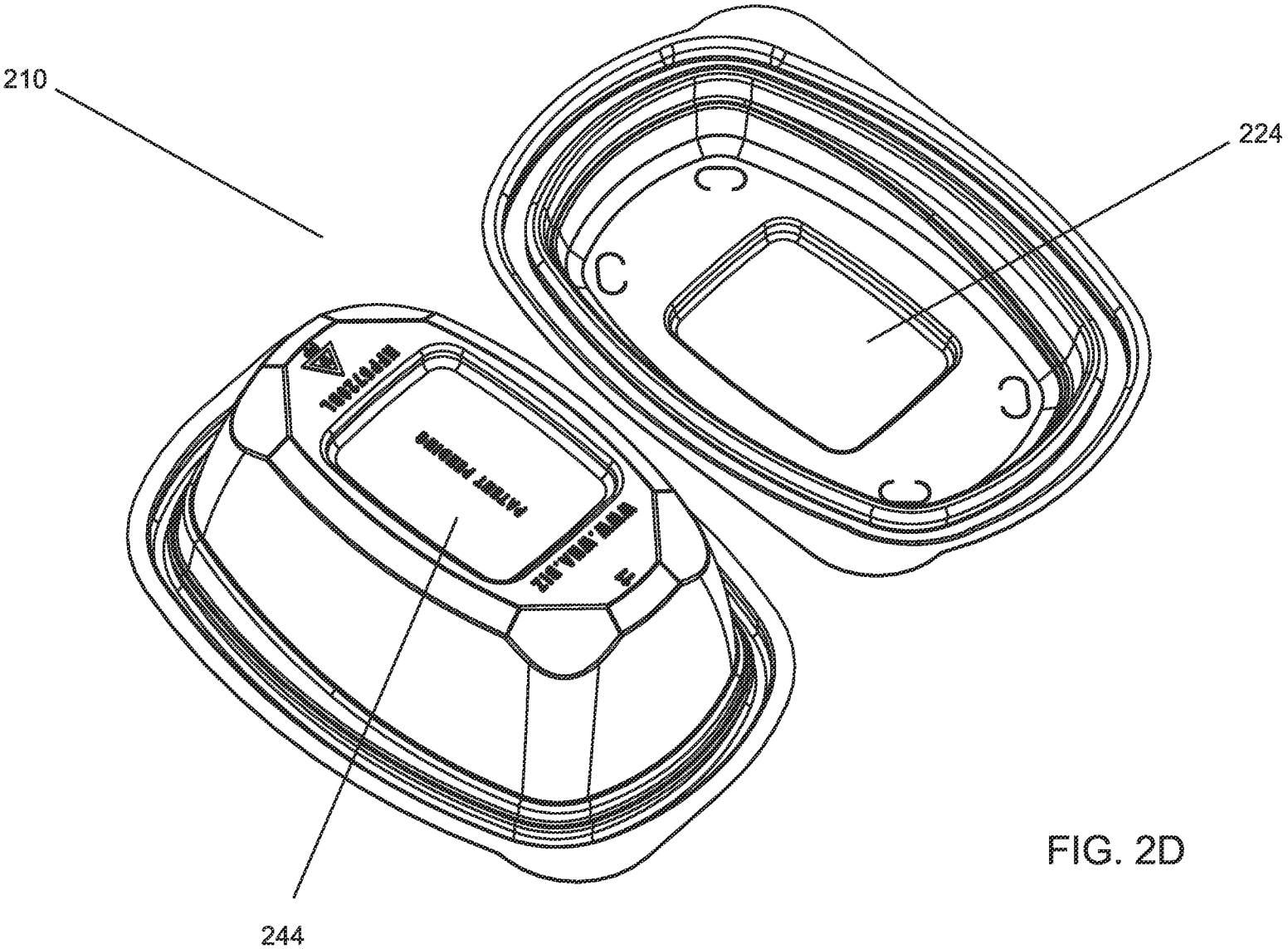
FIG. 2D is a bottom isometric view drawn to scale of the container assembly of FIG. 2C.
Figure 2E:
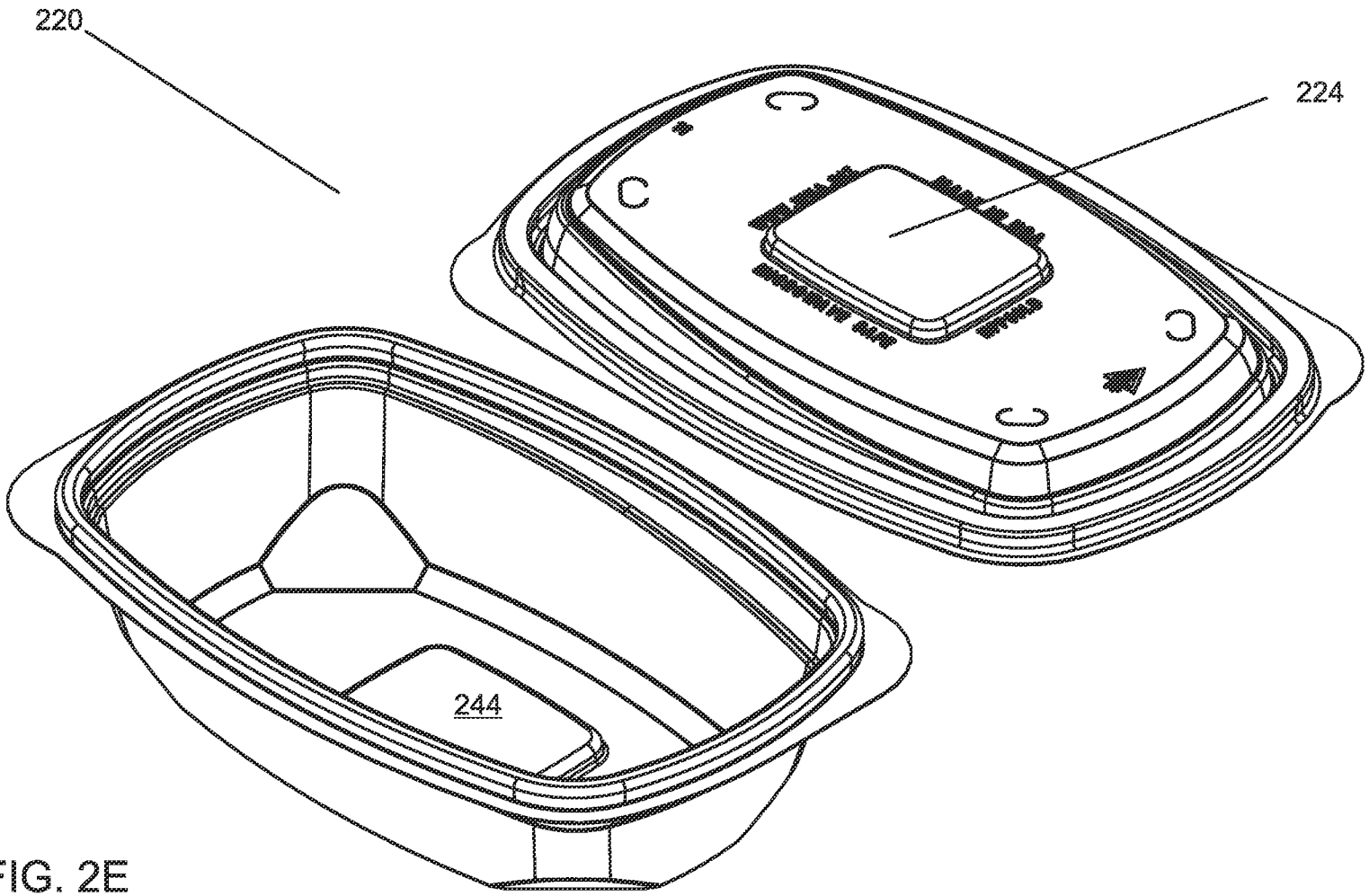
FIG. 2E is a top isometric view drawn to scale of an oblong container assembly having a lid that is separate from the base.
Figure 2F:
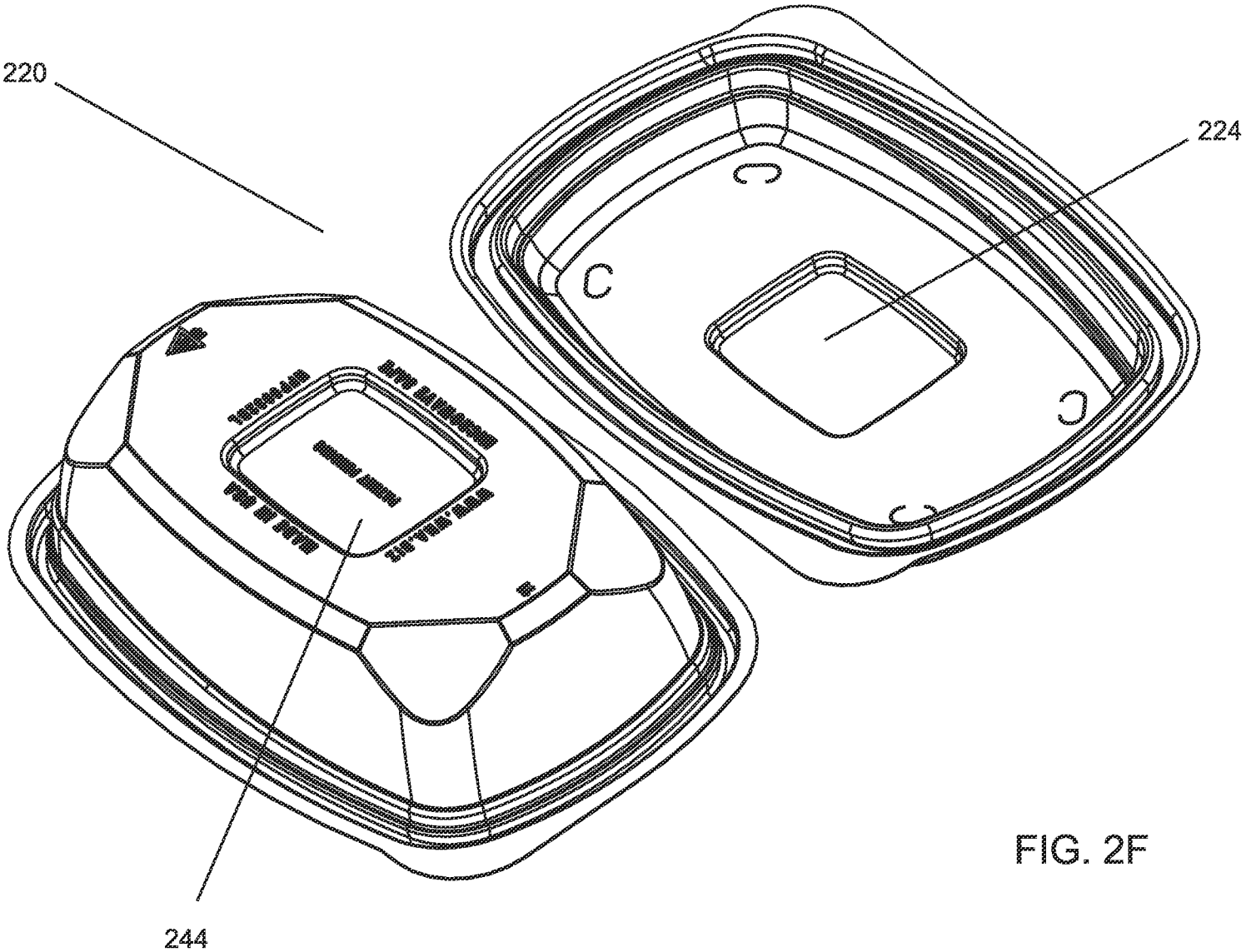
FIG. 2F is a bottom isometric view drawn to scale of the container assembly of FIG. 2E.
Figure 2G:
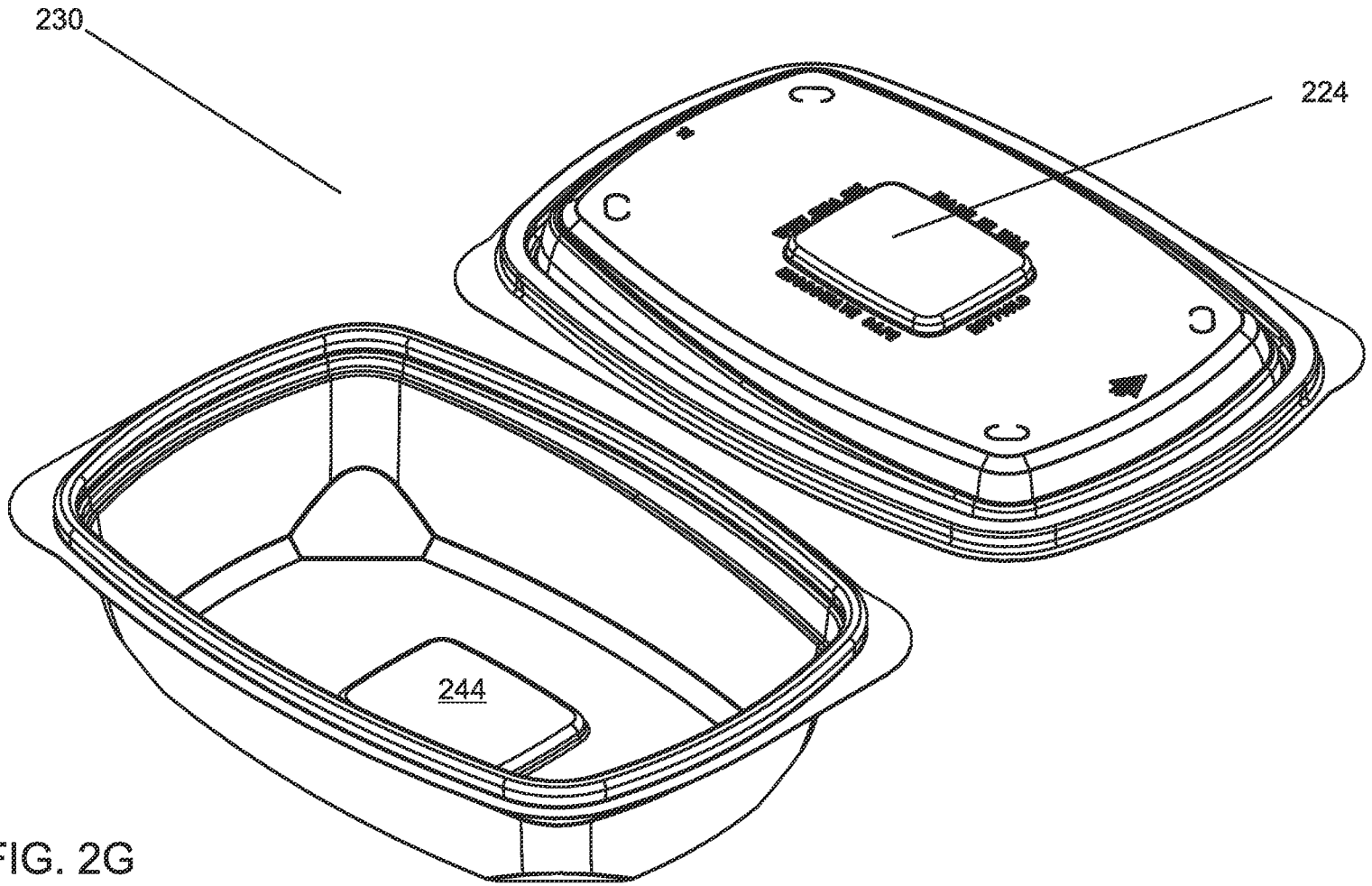
FIG. 2G is a top isometric view drawn to scale of an oblong container assembly similar to FIG. 2E having a lid that is separate from the base.
Figure 2H:
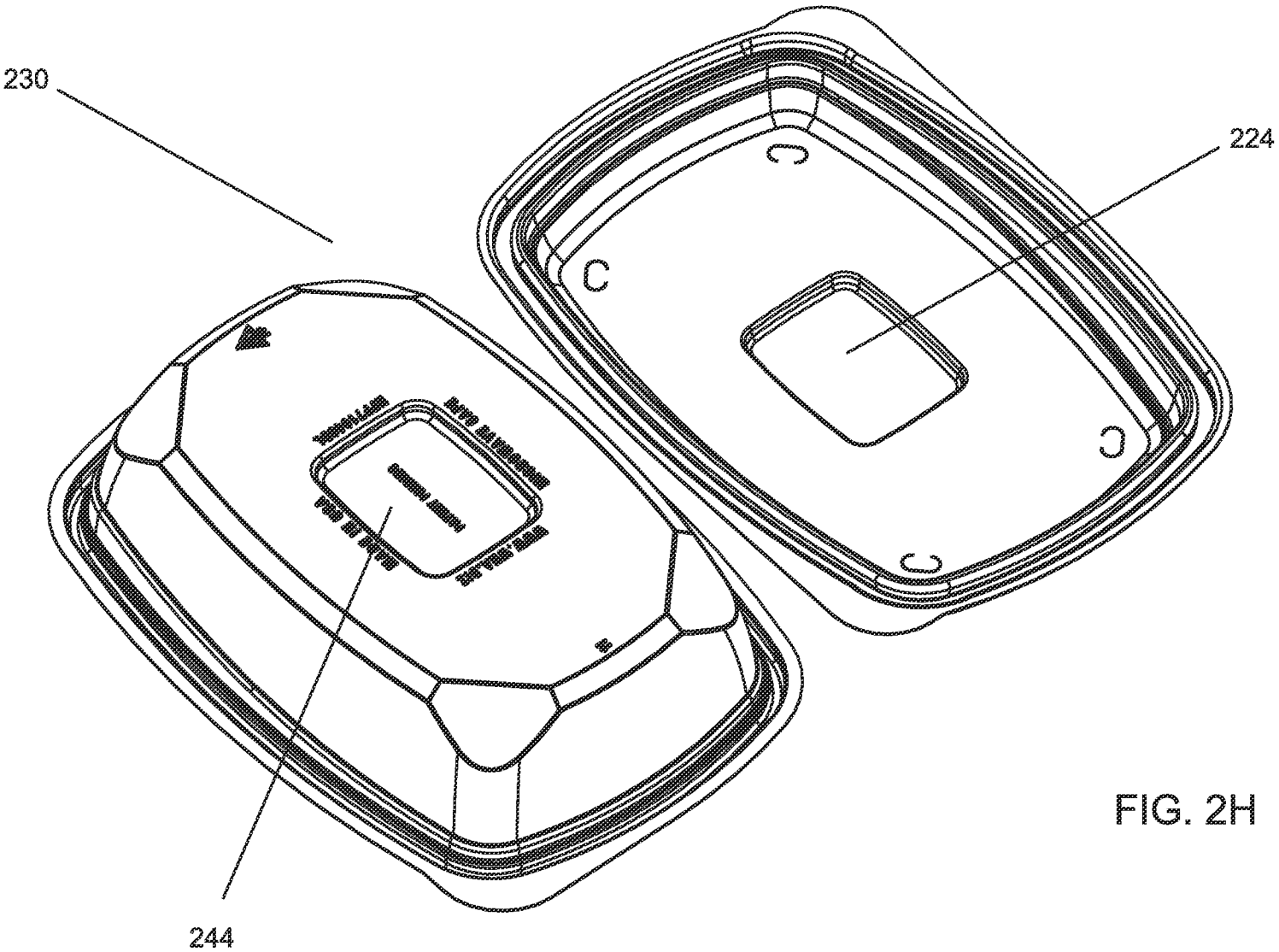
FIG. 2H is a bottom isometric view drawn to scale of the container assembly of FIG. 2G.

In yet another embodiment shown in FIGS. 2C-2D, container assembly 210 is oval and has a lid that is separated from the base. The embodiment of FIGS. 2D and 2E 220, and the embodiment 230 of FIGS. 2F and 2G, are both similar to the embodiment of FIGS. 2C and 2D, except for having different shapes. Note that the nesting features 224, 234 are given the same numbers for all of the embodiments in FIGS. 2A-2H, even though in general they may have different shapes and sizes in each embodiment.

Figure 3A:
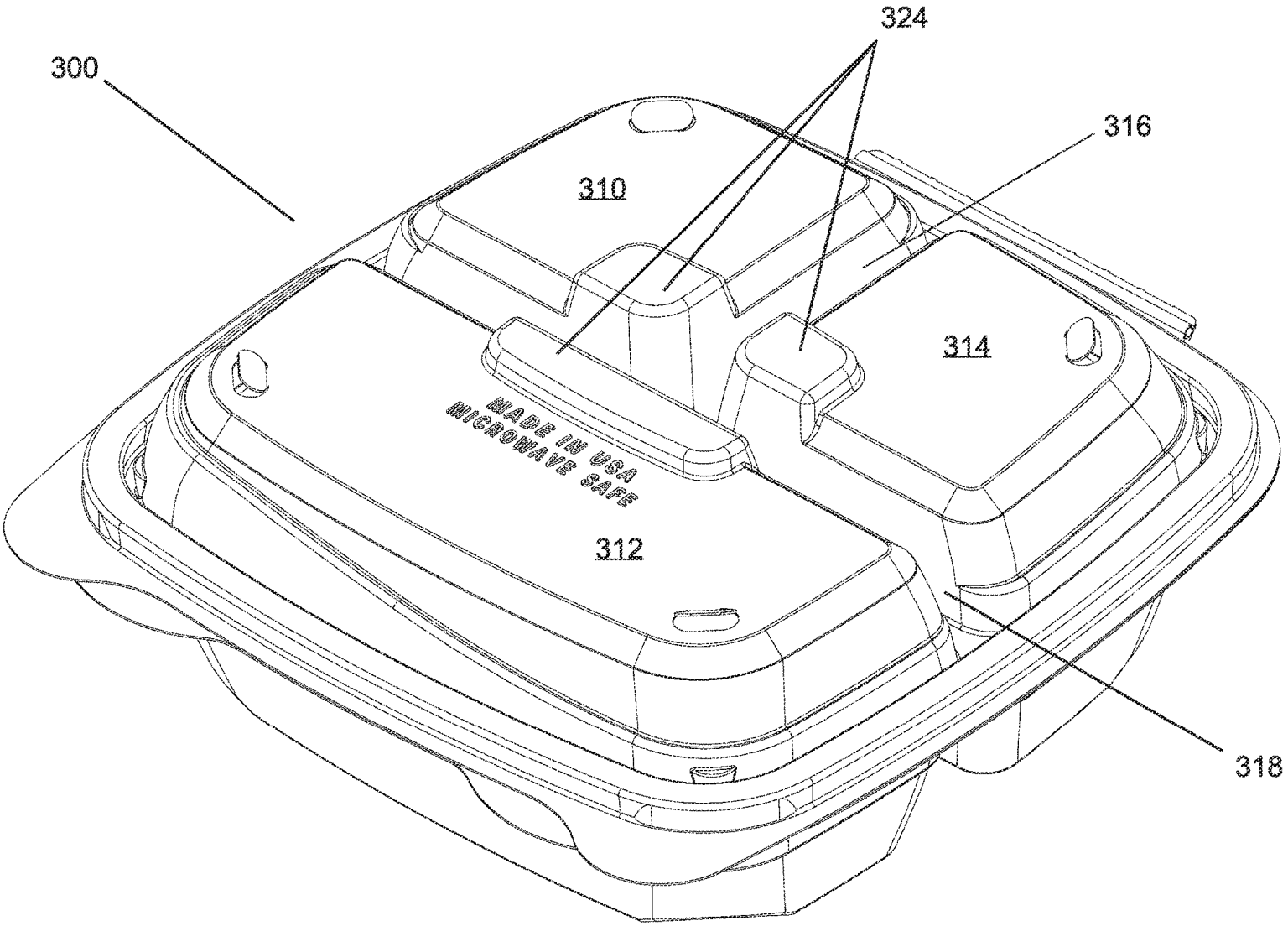
FIG. 3A is a top isometric view drawn to scale of a square container assembly having three compartments.
Figure 3B:
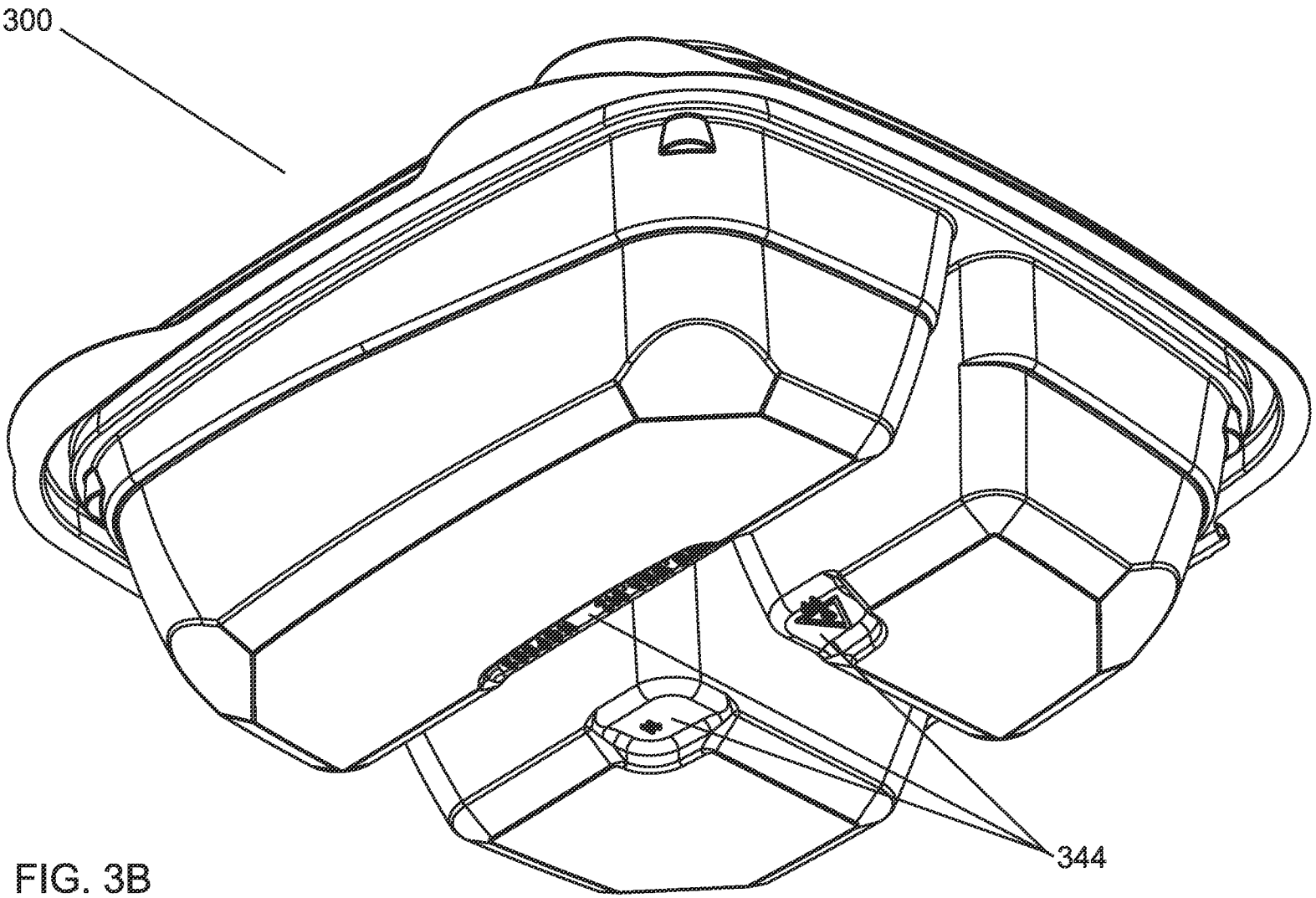
FIG. 3B is a bottom isometric view drawn to scale of the container assembly of FIG. 3A.

FIGS. 3A-3B illustrate an embodiment that is similar to the container assembly of FIGS. 2A-2B, except that container assembly 300 includes three separate cavities or compartments 310, 312, 314. Lid stacking projection 324 and base stacking recess 344 maintain the same size and peripheral footprint as lid stacking projections 124 and 224, and base stacking recesses 144 and 244. Separating channels 316, 318 between the compartments 310, 312, 314 provide additional means for ventilation of the assembly 300, for example providing passages through which hot air escaping from the assembly 300 can be vented.

Figure 3C:
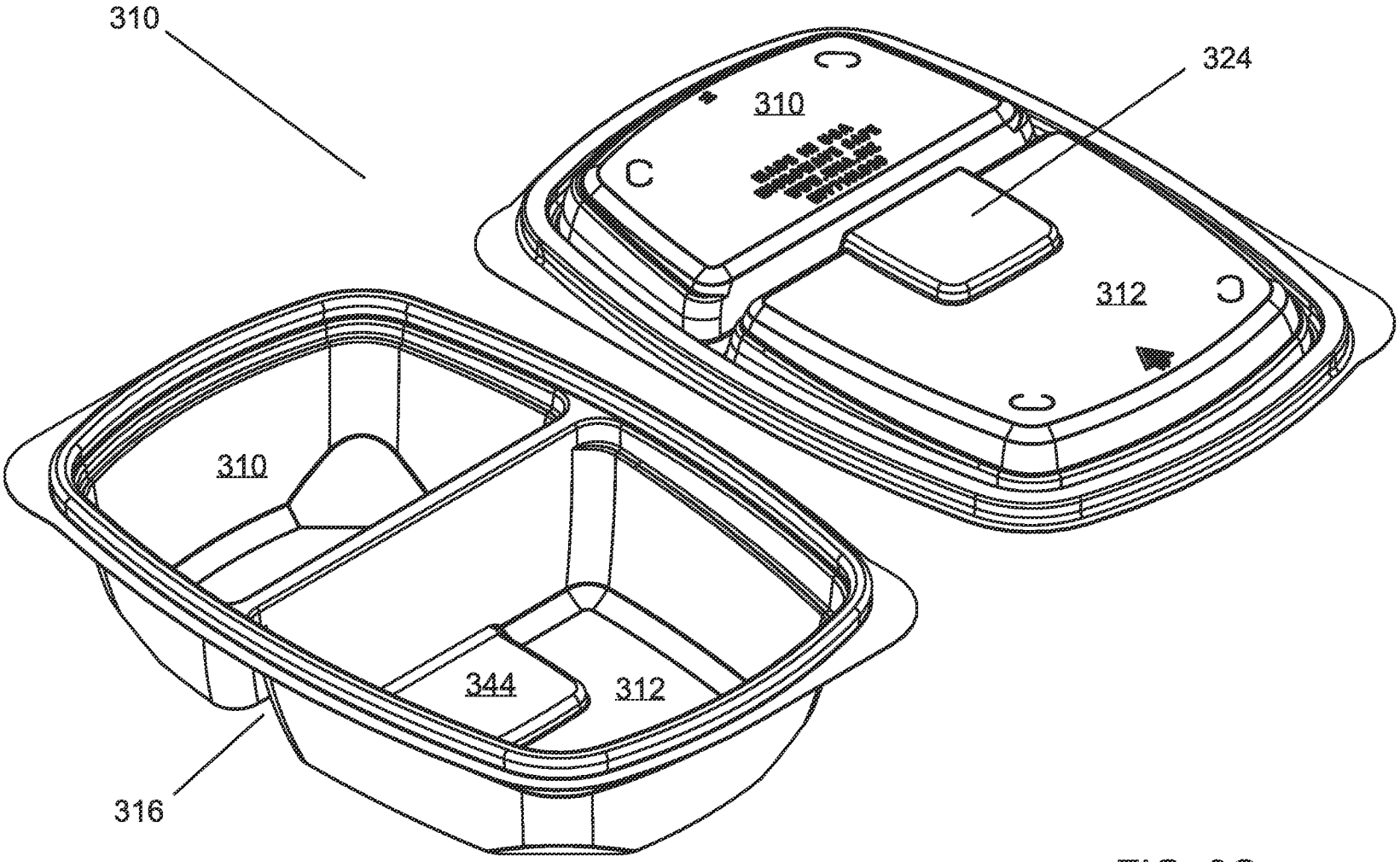
FIG. 3C is a top isometric view drawn to scale of a container assembly having two compartments, and having a lid that is separate from the base.
Figure 3D:
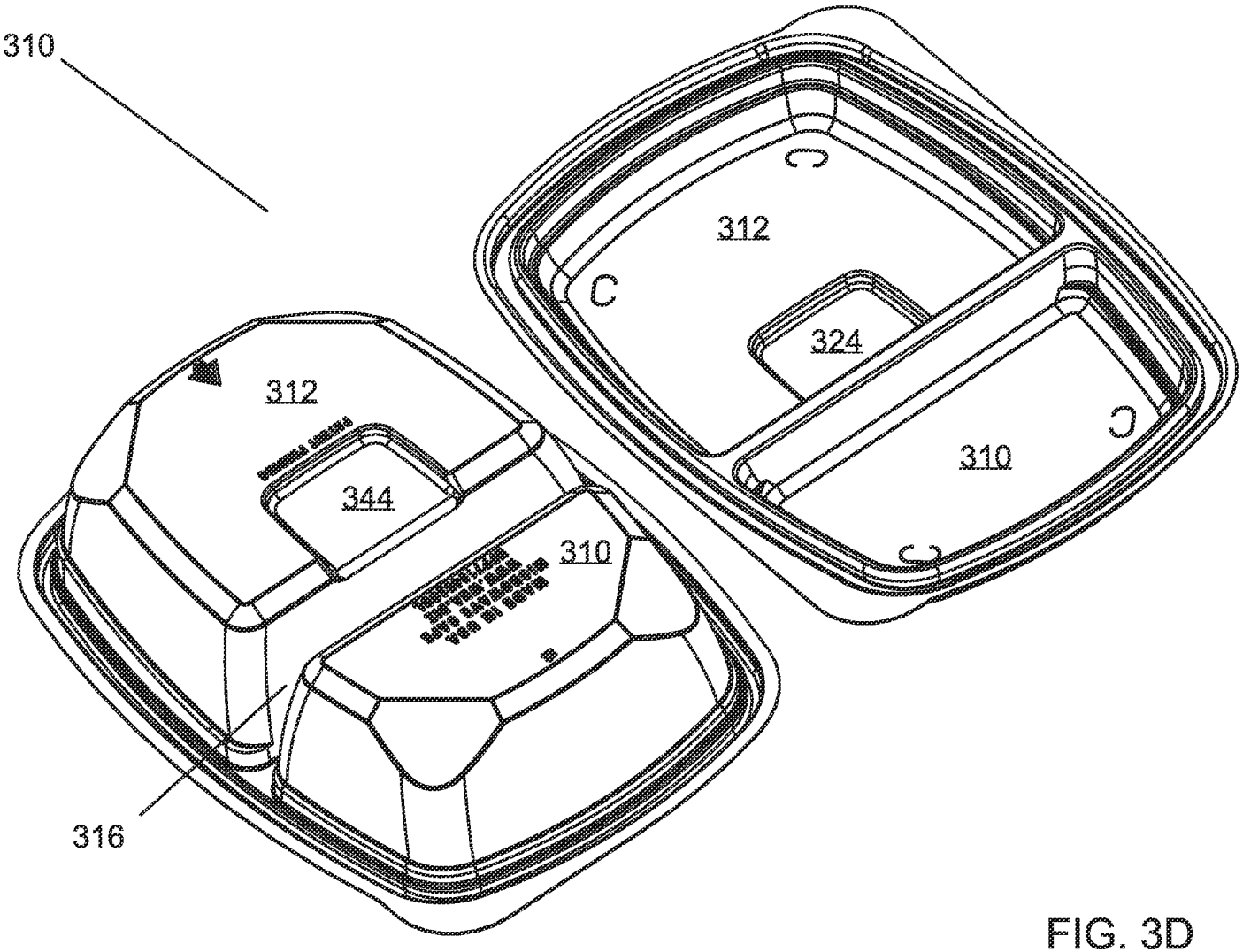
FIG. 3D is a bottom isometric view drawn to scale of the container assembly of FIG. 3C.

FIGS. 3C and 3D illustrate an embodiment 310 that is similar to the container assembly of FIGS. 3A and 3B, except that the container assembly 310 includes two separate cavities or compartments 310, 312, and the lid is separated from the base. Note that the compartments 310, 312 and nesting features 324,344 are given the same numbers in FIGS. 3A-3D, even though in general they may have different sizes and/or shapes in each embodiment.

Figure 4:
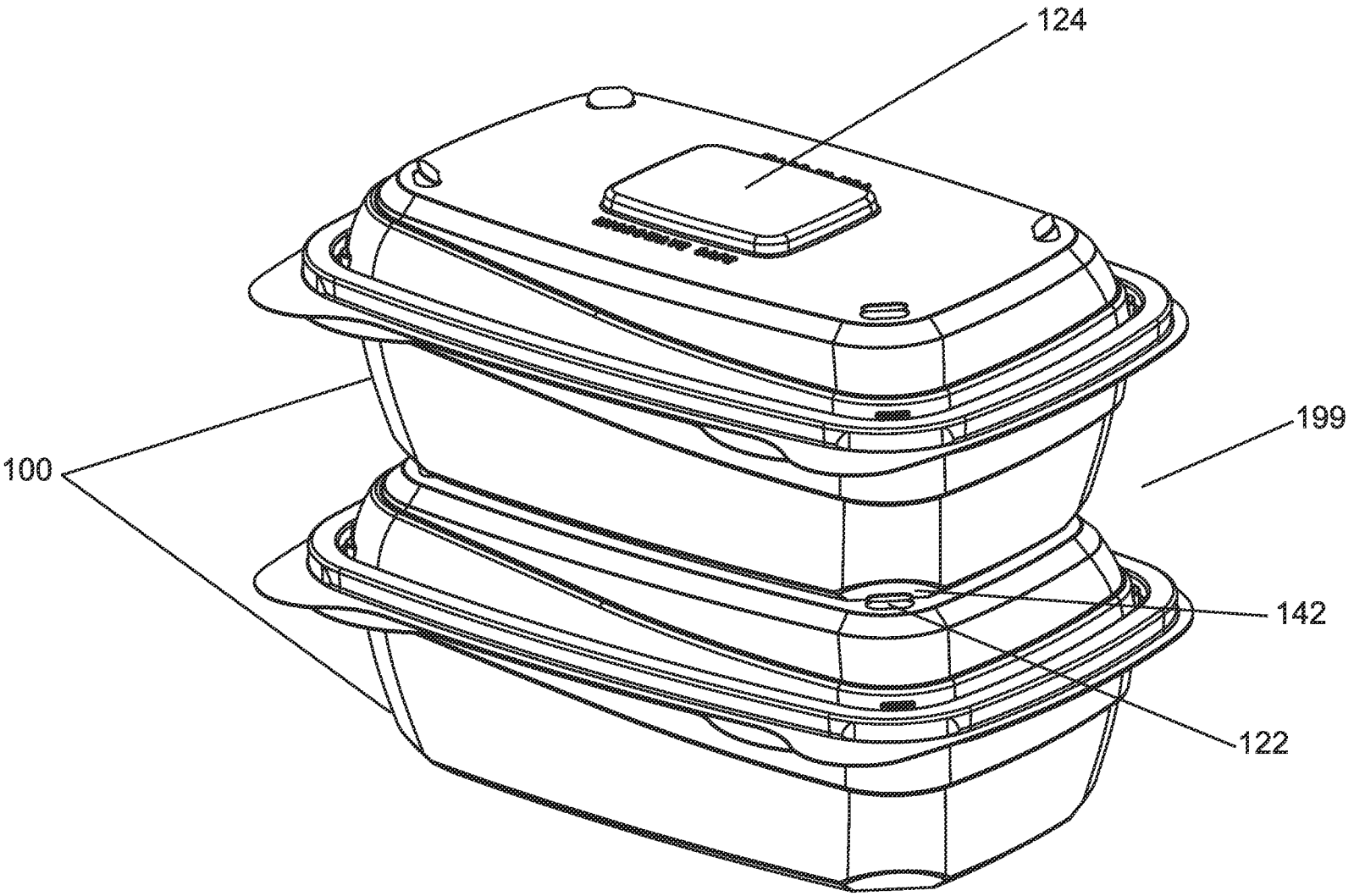
FIG. 4 is a top isometric view drawn to scale of a like stack of container assemblies of FIG. 1A.

FIG. 4 shows stack 199 of two container assemblies 100, wherein the lid vents 122 of the bottom container assembly corresponding with base vent chamfers 142 of the upper container assembly, thereby allowing the lid vents to remain open and unblocked while in the stacked configuration. Lid stacking projection 124 (not visible) of bottom container assembly 100 extends upward and fits into corresponding base stacking recess 144 (not visible) of container assembly 100 stacked on top. Corresponding lid stacking projections and base stacking recesses provided on the container assemblies allow stacking of a plurality of containers, thereby maintaining the stack in a stable, organized manner. In similar embodiments, the stacking projection and stacking recess are interchanged between the lid and base, such that the lid comprises a lid stacking recess that corresponds to a base stacking projection.

Figure 5A:
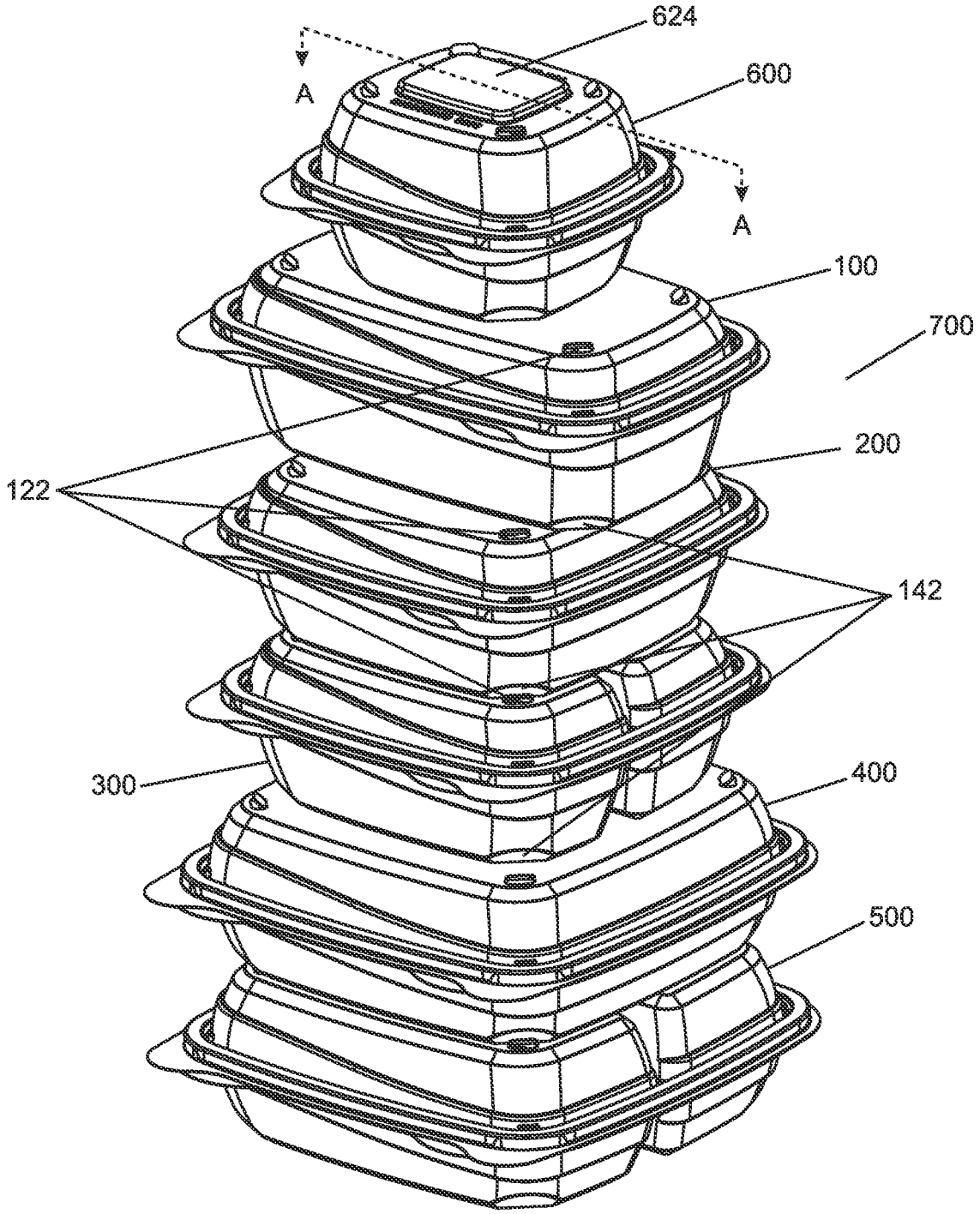
FIG. 5A is an isometric view drawn to scale of a stack of container assemblies of varying sizes and shapes.
Figure 5B:
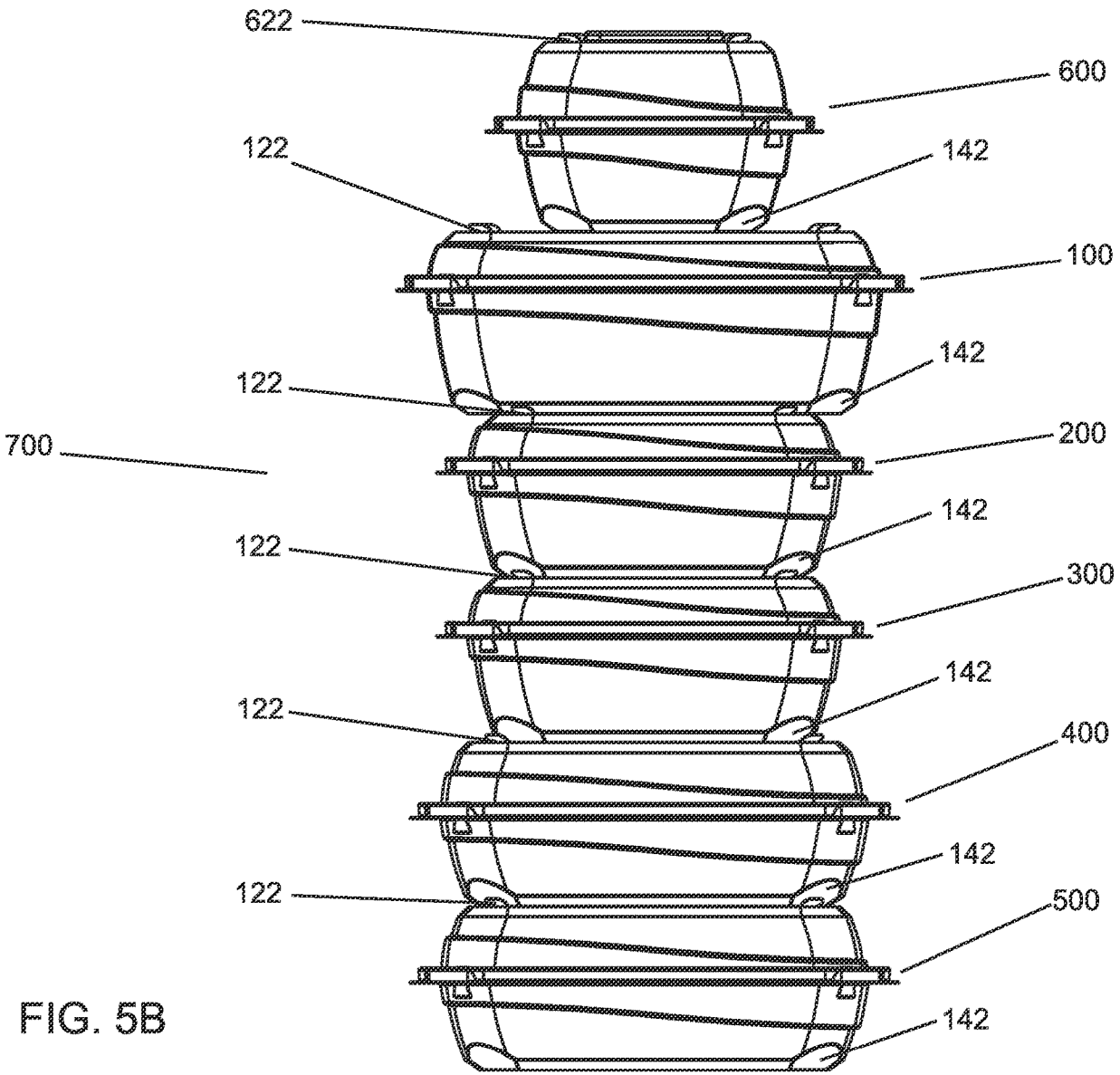
FIG. 5B is a front view drawn to scale of the stack of container assemblies of FIG. 5A.
Figure 5C:
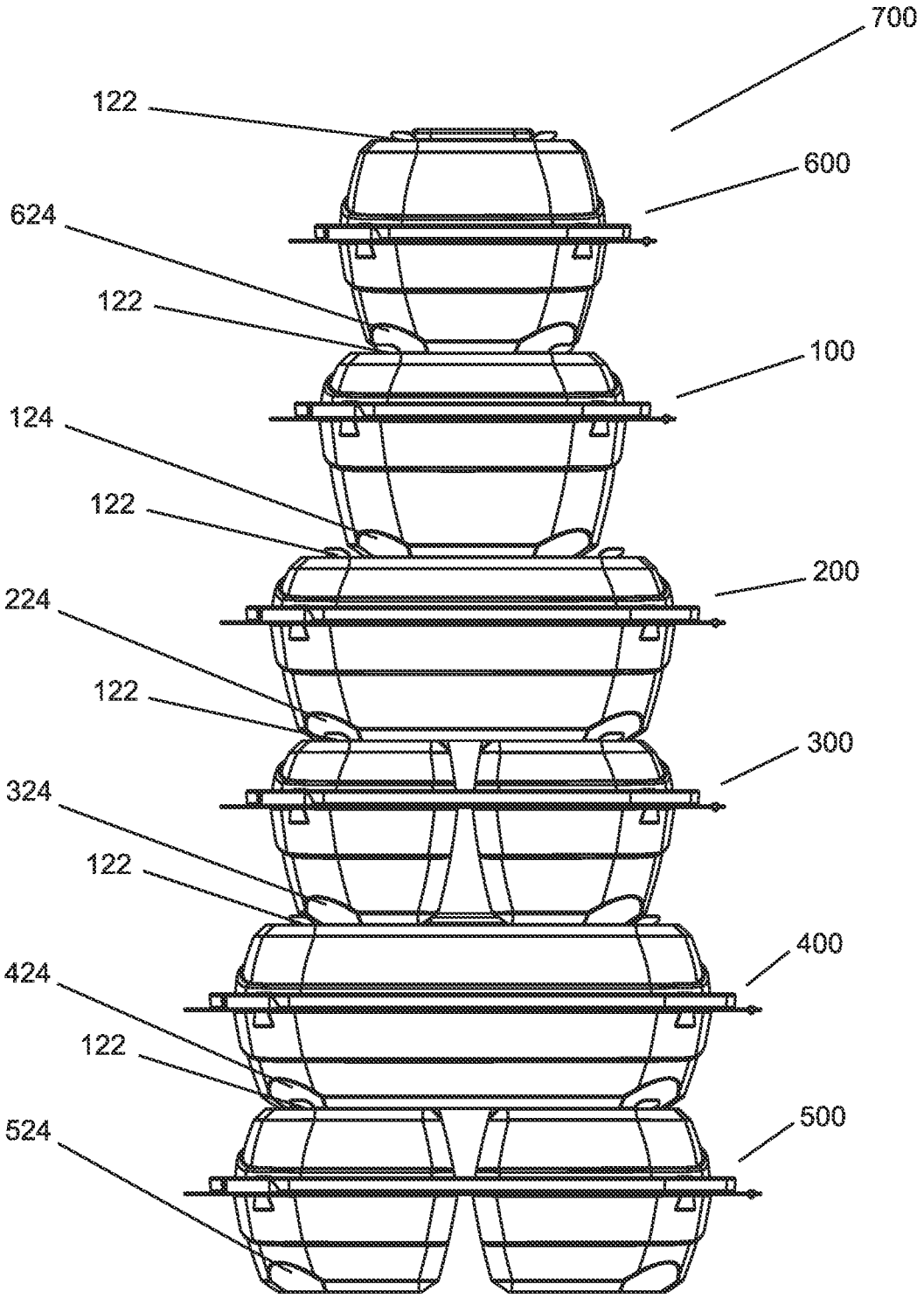
FIG. 5C is a right side view drawn to scale of the stack of container assemblies of FIG. 5A.

FIGS. 5A-C show a container family stack 700 of a plurality of six different container assemblies 100, 200, 300, 400, 500, and 600, stacked on top of each other. Family stack 700 is ideally stacked with largest container assembly 500 at the bottom proceeding up to the smallest container assembly 600 at the top of the family stack. The lid stacking projections (only 624 visible) and base stacking recesses (not visible) for each container each have the same peripheral footprint allowing for stacking of multiple container sizes and shapes. Family stack 700 permits lid vents 122 to remain open and unblocked whereby when two containers of the same size and shape are stacked then the base vent chamfers 142 of the upper container align with the vents 122 of the lower container, and when two containers having dissimilar sizes and shapes are stacked, then the vents of the lower container are not overlapped by the upper container. FIG. 5A is a perspective view of the container stack 700, FIG. 5B is a front view of the stack 700, and FIG. 5C is a right side view of the stack 700.

Figure 6:
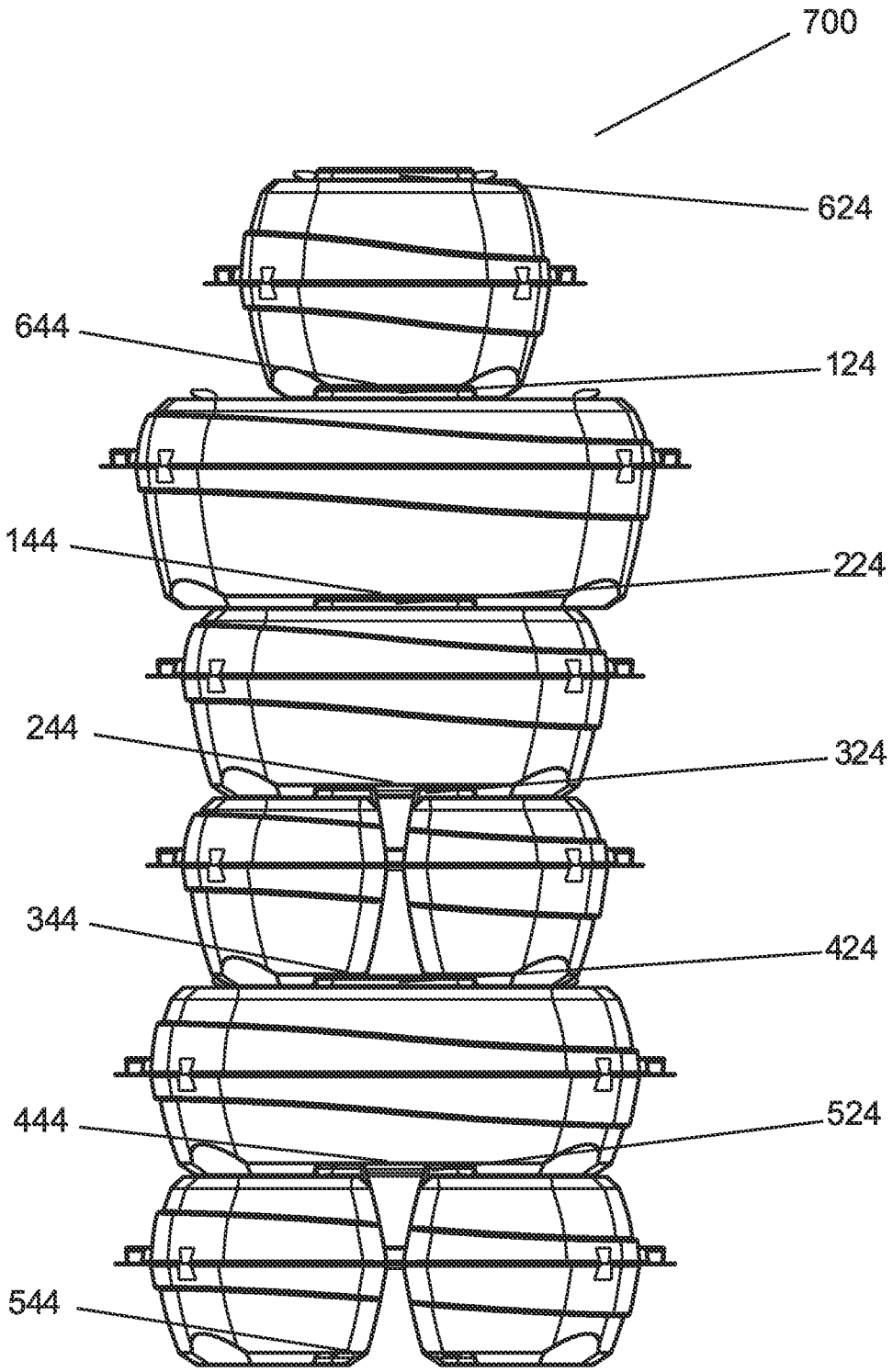
FIG. 6 shows cross section A-A drawn to scale of the stack of container assemblies of FIG. 5A, revealing the corresponding stacking projections and recesses.

FIG. 6 is a cross sectional view of the stack 700 of FIGS. 5A-5C, taken at location A-A as shown in FIG. 5A. The figure illustrates the interaction between each lid stacking projection 124, 224, 324, 424, 524, or 624 and base stacking recess 144, 244, 344, 444, 544, or 644 and the corresponding lid stacking projection or base stacking recess above or below it in the stack.

It should be noted that the term "container assembly" is used broadly herein to refer to any container or packaging, including but not limited to lid and base combinations, or hinged containers. The size of the lid or base may also be increased or decreased to accommodate a variety of foods, types of goods and amounts. Furthermore the container assembly features such as the cavity, sealing channel, vents, and tabs may be presented or arranged in a variety of quantities, shapes, or configurations without departing from the spirit of the invention. Examples of shapes for the container assembly, the cavities, or both could include circular, elliptical, or polygonal. For example, in embodiments round containers include round projections and corresponding round recesses, and further include a continuous base chamfer that extends around the base perimeter, so that vent provided at any locations around the periphery of the lid are not blocked by a next-higher container in a stack, regardless of the relative orientation of the containers.

Depending on the embodiment, the base may have one or a plurality of cavities, while the lid may be correspondingly engineered with a plurality of barriers to enclose or isolate each cavity. The exterior of the lid and/or base of the container assembly may include corresponding features such as ridges and depressions that aid in stacking of multiple containers. The lid and/or base may include de-nesting lugs to allow for easier or automated separation of a nested stack of empty parts.

It should further be noted that some embodiments of the present invention include disposable containers, containers constructed from materials such as paper, plastic, foam, bagasse, laminated materials, compostable materials, biodegradable materials, bioplastics, recycled materials, and/or plastic blends and compounds. The container and/or each of the lid or base may be disposable or alternately may be permanent ware, intended to be cleaned and re-used, or hybrid combinations wherein, for example, a permanent base is paired with a disposable lid.

In an embodiment, one or more parts of the container may be manufactured by at least one of thermoforming, injection molding, compression molding, vacuum forming, pressure forming, hydro forming, or any other known method.

Further embodiments of the invention provide that the container is thermoformed from a sheet of plastic material.

In other embodiments, the container is thermoformed from a suitable grade of polyethylene terephthalate, commonly known as PETE.

In some embodiments the container, or one or both of the lid and base, may be of any desired color, and may be clear, frosted or transparent.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A container set comprising:

first and second container assemblies suitable for containing food items, each of said container assemblies comprising:

a lid comprising a lid top wall, a lid sidewall, and a lid peripheral rim, said lid top wall comprising at least one vent and a container lid stacking feature;

a base having a base bottom wall, a base sidewall, and a base peripheral rim, said base comprising at least one chamfer and a container base stacking feature, said chamfers being beveled features provided at separated locations about the base, each of said chamfers comprising a substantially planar face extending at an oblique angle from a location on the base bottom wall to a location on the base side wall, each of said chamfers of the base being positioned below a corresponding one of the vents of the lid;

said lid and base being mutually engageable to form the container assembly;

wherein said first and second container assemblies differ from each other in at least one of size and shape, said first container assembly being adapted for supporting the second container assembly in a stacked configuration;

wherein, when the first and second container assemblies are in the stacked configuration:

said first container lid stacking feature engages with said second container base stacking feature; and each of the vents of the lid of the first container that is overlapped by the base of the second container is aligned with a corresponding chamfer of the base of the second container, such that all of the vents included in the lid of the first container assembly remain unblocked by said second container assembly.

2. The container set of claim 1, wherein for each of the container assemblies, the lid stacking feature is centrally located on the lid top wall and the base stacking feature is centrally located on the base bottom wall.

3. The container set of claim 1, wherein at least one of the vents of the first container assembly is a hole provided in the lid of the first container assembly.

4. The container set of claim 1, wherein at least one of the vents of the first container assembly is a "C" vent formed into the top wall of the lid of the first container assembly.

5. The container set of claim 1, wherein the lid and base of the first container assembly are separate elements of the first container assembly.

6. The container set of claim 1, wherein the lid and base of the first container assembly are joined to each other by a hinge.

7. The container set of claim 6, wherein the hinge is a living hinge.

8. The container set of claim 1, wherein at least one of the lid and base of the first container assembly is made of plastic, and is structurally compatible with manufacture thereof by thermoforming.

9. The container set of claim 1, wherein the top wall of the lid of the first container assembly comprises at least four vents.

10. The container set of claim 1, wherein the vents of the lid of the first container assembly are formed planar with the top wall of the lid of the first container assembly.

11. The container set of claim 1, wherein each of the bases of the first and second container assemblies includes a plurality of compartments that are separated by channels formed in the base, such that when the first and second container assemblies are in the stacked configuration, the channels formed in the base of the second container assembly provide passages through which heated air escaping from the vents in the lid of the first container assembly can escape to the surrounding environment.

12. The container set of claim 1, wherein the first and second container assemblies differ in at least one of a width thereof and a length thereof.

13. The container set of claim 1, wherein the first and second container assemblies differ in both widths thereof and lengths thereof.

14. The container set of claim 13, wherein a ratio of the width and length of the first container is equal to a corresponding ratio of the width and length of the second container.

* * * * *